US008059044B2

(12) United States Patent
Rode et al.

(10) Patent No.: US 8,059,044 B2
(45) Date of Patent: Nov. 15, 2011

(54) ANTENNA MOUNTING APPARATUS AND METHODS INCLUDING CLAW FASTENERS AND/OR BAYONET LOCKING STRUCTURES

(75) Inventors: Nils Rode, Harsum (DE); Jens Simon, Algermissen (DE); Gerd Kallmeyer, Dresden (DE)

(73) Assignee: Laird Technologies GmbH, Hildesheim (DE)

( * ) Notice: Subject to any disclaimer, the term of this patent is extended or adjusted under 35 U.S.C. 154(b) by 443 days.

(21) Appl. No.: 12/464,339

(22) Filed: May 12, 2009

(65) Prior Publication Data

US 2009/0284439 A1 Nov. 19, 2009

Related U.S. Application Data

(60) Provisional application No. 61/053,377, filed on May 15, 2008.

(51) Int. Cl.
*H01Q 1/32* (2006.01)

(52) U.S. Cl. ..... 343/713; 343/878

(58) Field of Classification Search ..... 343/713, 343/878, 906

See application file for complete search history.

(56) References Cited

U.S. PATENT DOCUMENTS

| | | | | |
|---|---|---|---|---|
| 4,867,698 | A | 9/1989 | Griffiths | |
| 5,714,963 | A | 2/1998 | Cox | |
| 7,212,168 | B2 | 5/2007 | Kozlovski | |
| 7,236,136 | B2 | 6/2007 | Noro | |
| 7,268,734 | B2 | 9/2007 | Cislo | |
| 7,679,572 | B2 * | 3/2010 | Gray et al. | 343/713 |
| 7,710,333 | B2 * | 5/2010 | Byrne et al. | 343/713 |
| 2006/0103579 | A1 | 5/2006 | Blickle | |
| 2007/0145226 | A1 | 6/2007 | Kozlovski | |
| 2007/0279302 | A1 | 12/2007 | Byrne et al. | |

FOREIGN PATENT DOCUMENTS

| | | | |
|---|---|---|---|
| DE | 202006000720 | U1 | 1/2006 |
| DE | 102006009660 | | 9/2007 |
| EP | 1703607 | A1 | 9/2006 |
| EP | 1792361 | A1 | 6/2007 |
| EP | 1994602 | A1 | 9/2007 |
| EP | 1851819 | A1 | 11/2007 |
| GB | 759020 | | 10/1956 |
| WO | WO 2006/029938 | A1 | 3/2006 |
| WO | WO 2006/087225 | A1 | 8/2006 |
| WO | PCT/EP2007/000376 | | 1/2007 |
| WO | WO 2007/082727 | A1 | 7/2007 |
| WO | WO 2007/098996 | A1 | 9/2007 |

OTHER PUBLICATIONS

U.S. Appl. No. 12/161,184, filed Jul. 17, 2008, Ulrich Steinkamp et al.

* cited by examiner

*Primary Examiner* — Tan Ho

(74) *Attorney, Agent, or Firm* — Harness, Dickey & Pierce, P.L.C.

(57) ABSTRACT

According to various aspects, exemplary embodiments are provided of apparatus and methods relating to mounting antenna components, modules, and assemblies, such as antenna modules or RF amplifier modules. In an exemplary embodiment, a fastener includes a clamping portion. An actuator is configured to convert a rotational force applied for rotating the fastener into a clamping force applied to the mounting surface generally between the at least one antenna component and the clamping portion of the fastener, to thereby mount the at least one antenna component to the mounting surface.

28 Claims, 15 Drawing Sheets

ANTENNA MOUNTING APPARATUS AND METHODS INCLUDING CLAW FASTENERS AND/OR BAYONET LOCKING STRUCTURES

CROSS-REFERENCE TO RELATED APPLICATION

This application claims the benefit of U.S. Provisional Application No. 61/053,377 filed May 15, 2008. The entire disclosure of this provisional application is incorporated herein by reference in its entirety.

FIELD

The present disclosure relates to antenna mounting apparatus and methods including claw fasteners and/or bayonet locking structures, such as for mounting automobile or vehicular antenna modules, assemblies, and/or components to mounting surfaces, such as vehicle roofs, hoods, or trunk lids.

BACKGROUND

This section provides background information related to the present disclosure which is not necessarily prior art.

Various antenna types are used in the automotive industry, including aerial AM/FM antennas, patch antennas, etc. Antennas for automotive use are commonly positioned on the vehicle's roof, hood, or trunk lid to help provide the antenna with an unobstructed view overhead or towards the zenith. By way of example, an antenna module may be fixed to a vehicle's metallic body wall by using a two-handed method (i.e., a method that requires the installer to use both hands) and/or a method that requires separate mechanical fasteners (e.g., screw and nut assemblies, etc.) to be added during the mounting process on the production line. One example installation method includes mounting an antenna to a vehicle body wall using an M14 thread and nut, where the nut is an extra part required for mounting. Another example installation method includes mounting an antenna to a vehicle body wall using two nuts. Still a further example installation method includes the use of adhesive tape for mounting the antenna to a vehicle body wall.

SUMMARY

This section provides a general summary of the disclosure, and is not a comprehensive disclosure of its full scope or all of its features.

According to various aspects, exemplary embodiments are provided of apparatus and methods relating to mounting antenna components, modules, and assemblies, such as antenna modules or RF amplifier modules. In an exemplary embodiment, a fastener includes a clamping portion. An actuator is configured to convert a rotational force applied for rotating the fastener into a clamping force applied to the mounting surface generally between the at least one antenna component and the clamping portion of the fastener, to thereby mount the at least one antenna component to the mounting surface.

Other aspects of the present disclosure include methods relating to mounting antenna components, modules, assemblies, etc. to mounting surfaces. In one exemplary embodiment, a method generally includes attaching a fastener to at least one antenna component (e.g., chassis, etc.) prior to mounting the at least one antenna component to the mounting surface. The fastener may be attached to the at least one antenna component by way of a pin engaged within one or more slots defined by one of the fastener or the at least one antenna component and within one or more openings defined by the other one of the fastener or the at least one antenna component. The slots may be defined such that the pin is slidable within the slots for converting a rotational force applied for rotating the fastener into a clamping force applied to the mounting surface generally between the at least one antenna component and a clamping portion of the fastener.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 11:
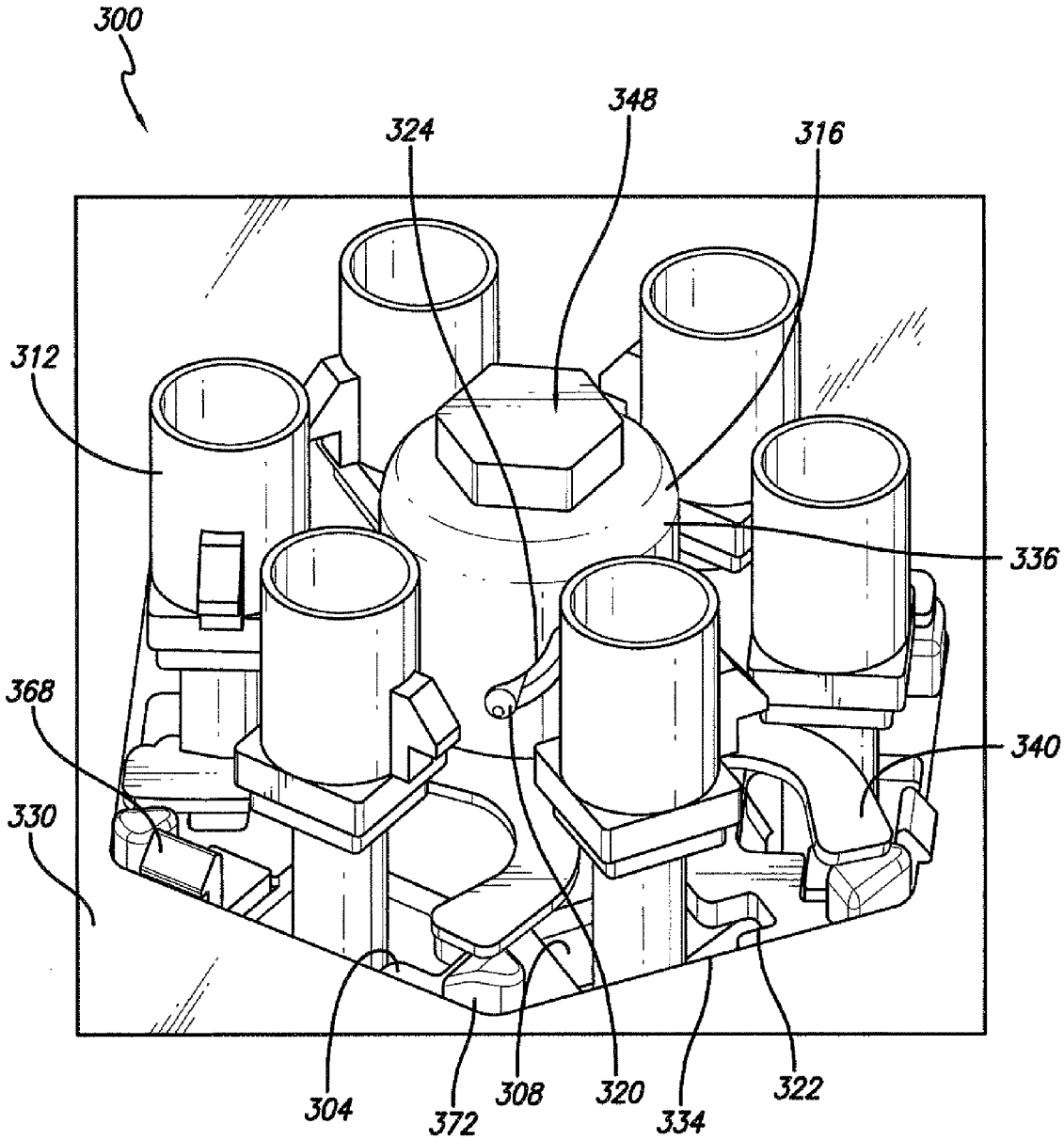
Figure 12:
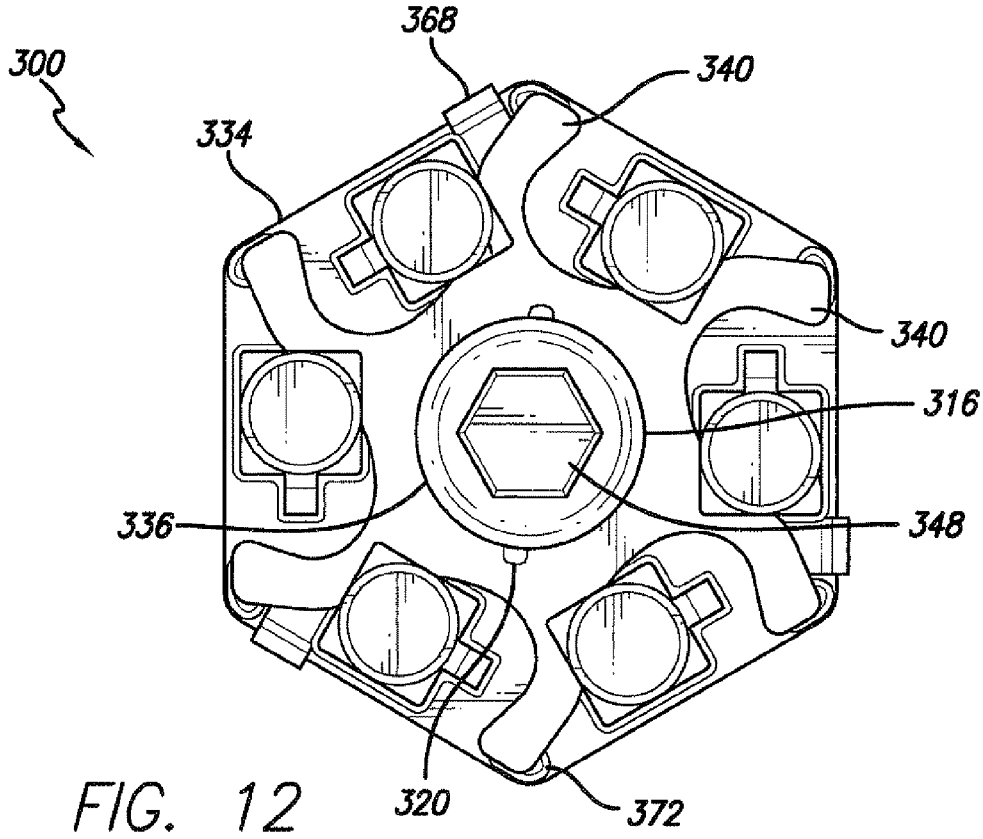
Figure 13:
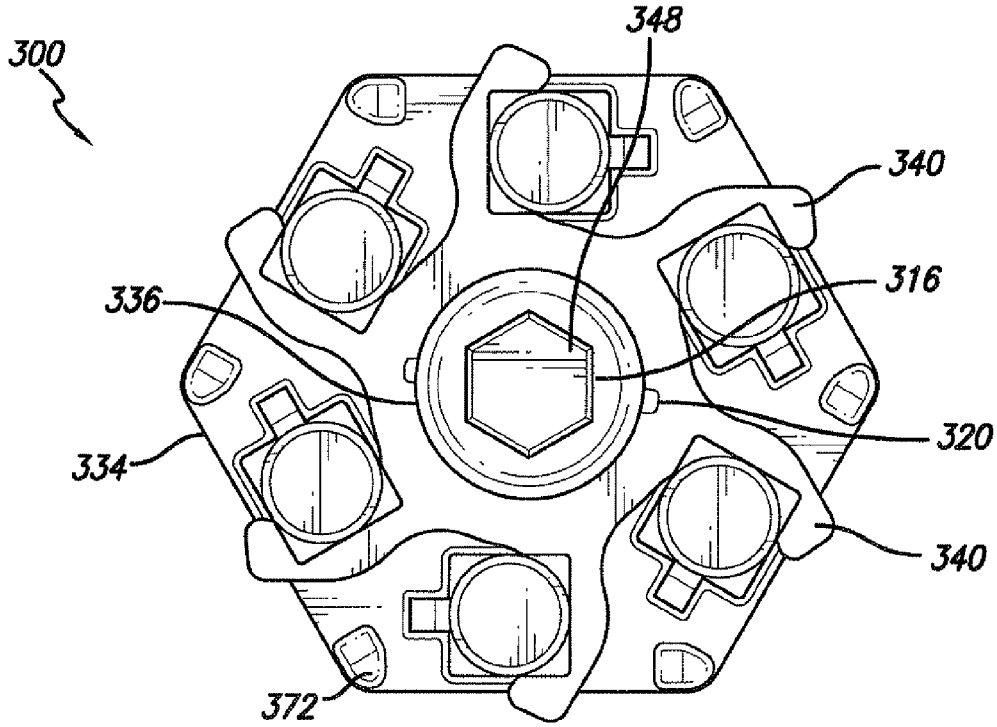
Figure 14:
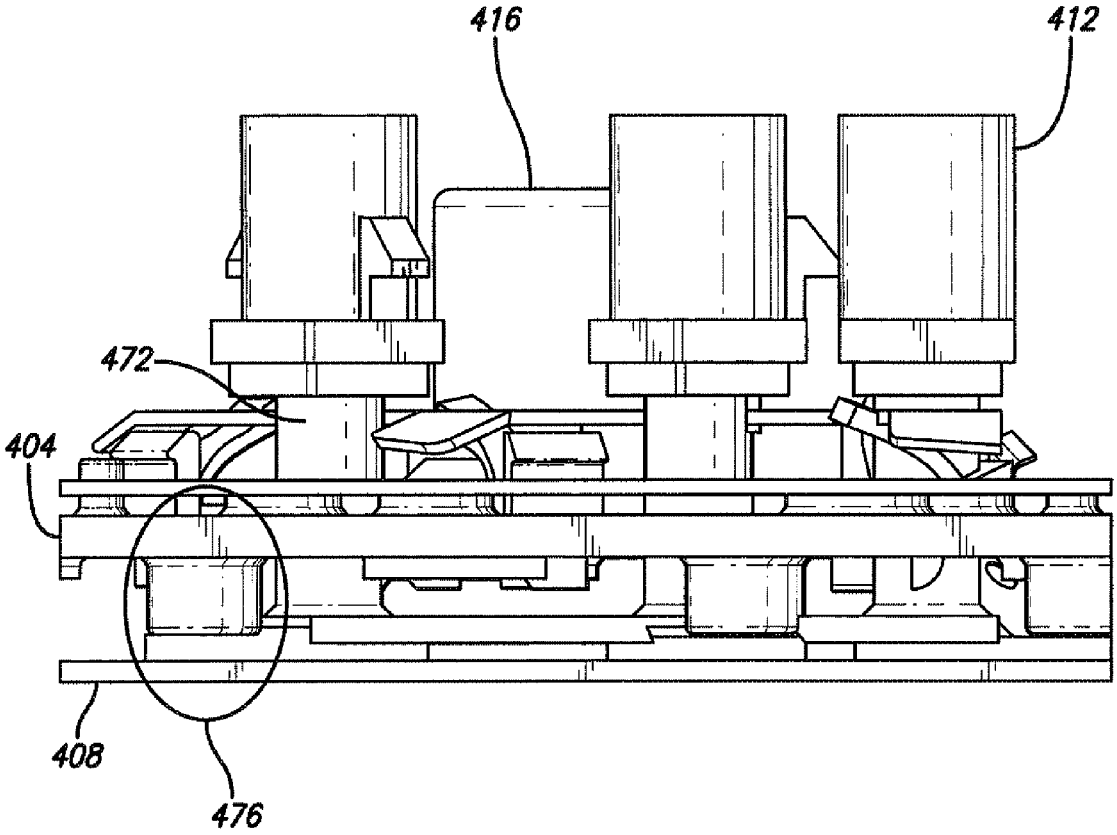
Figure 15:
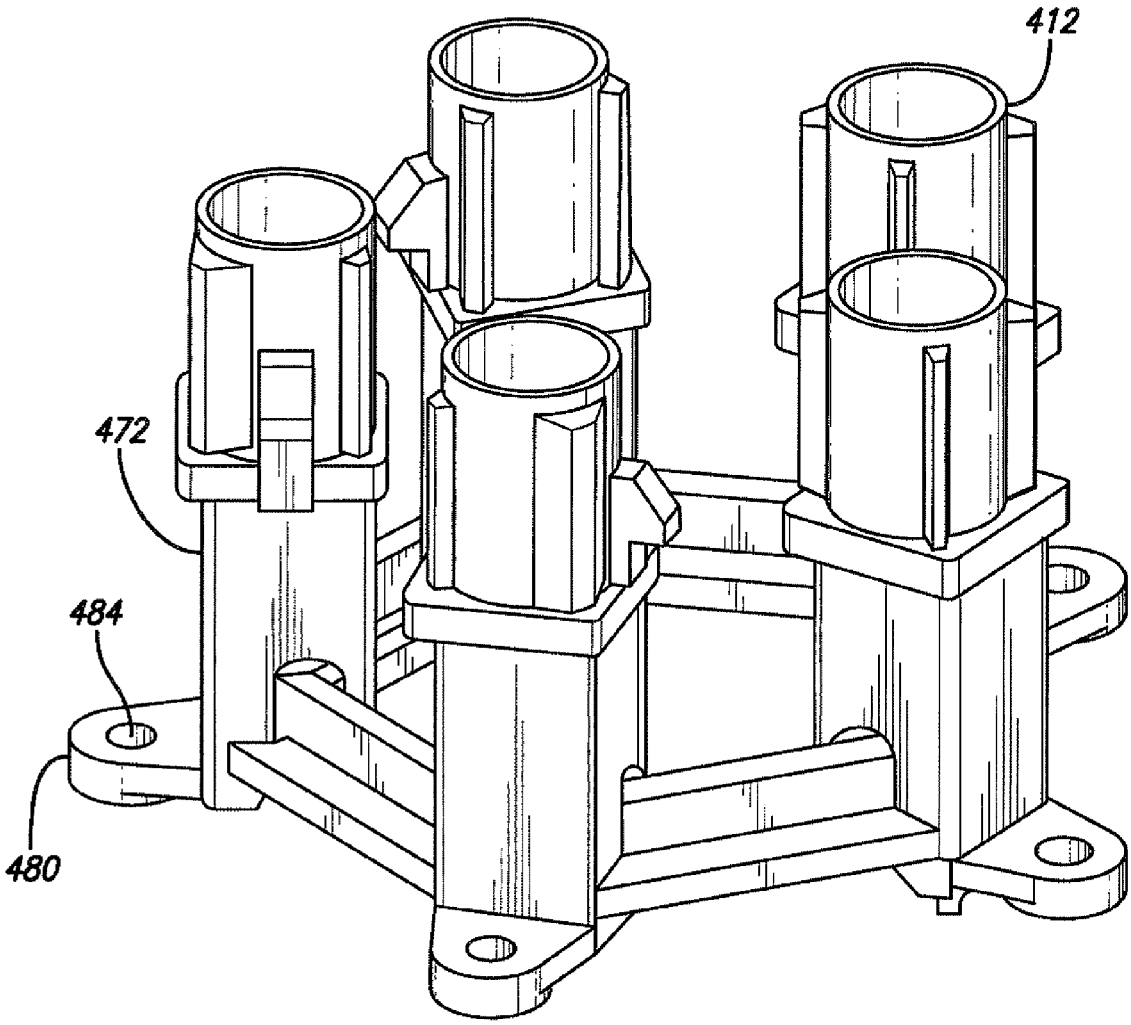
Figure 16:
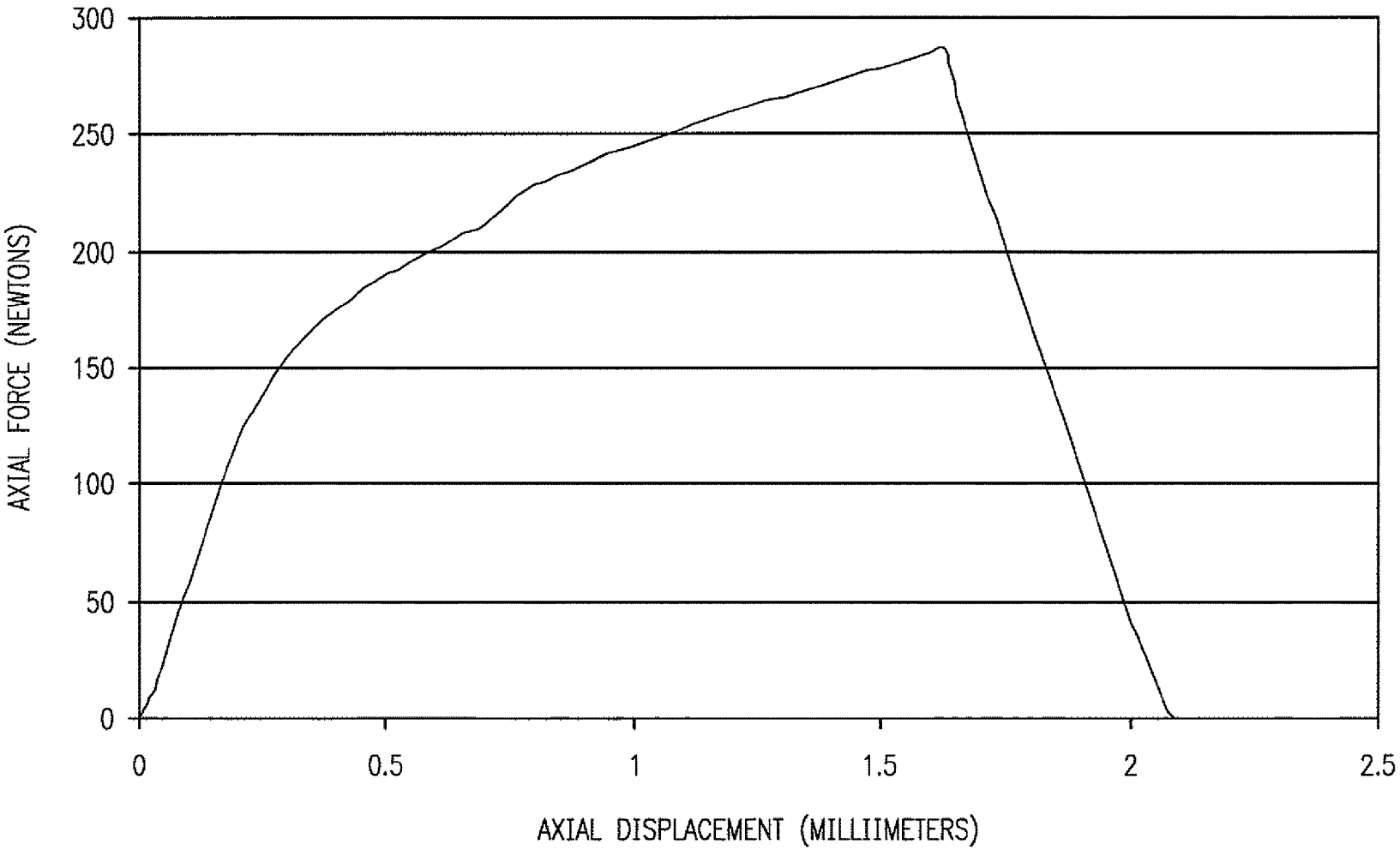
Figure 17:
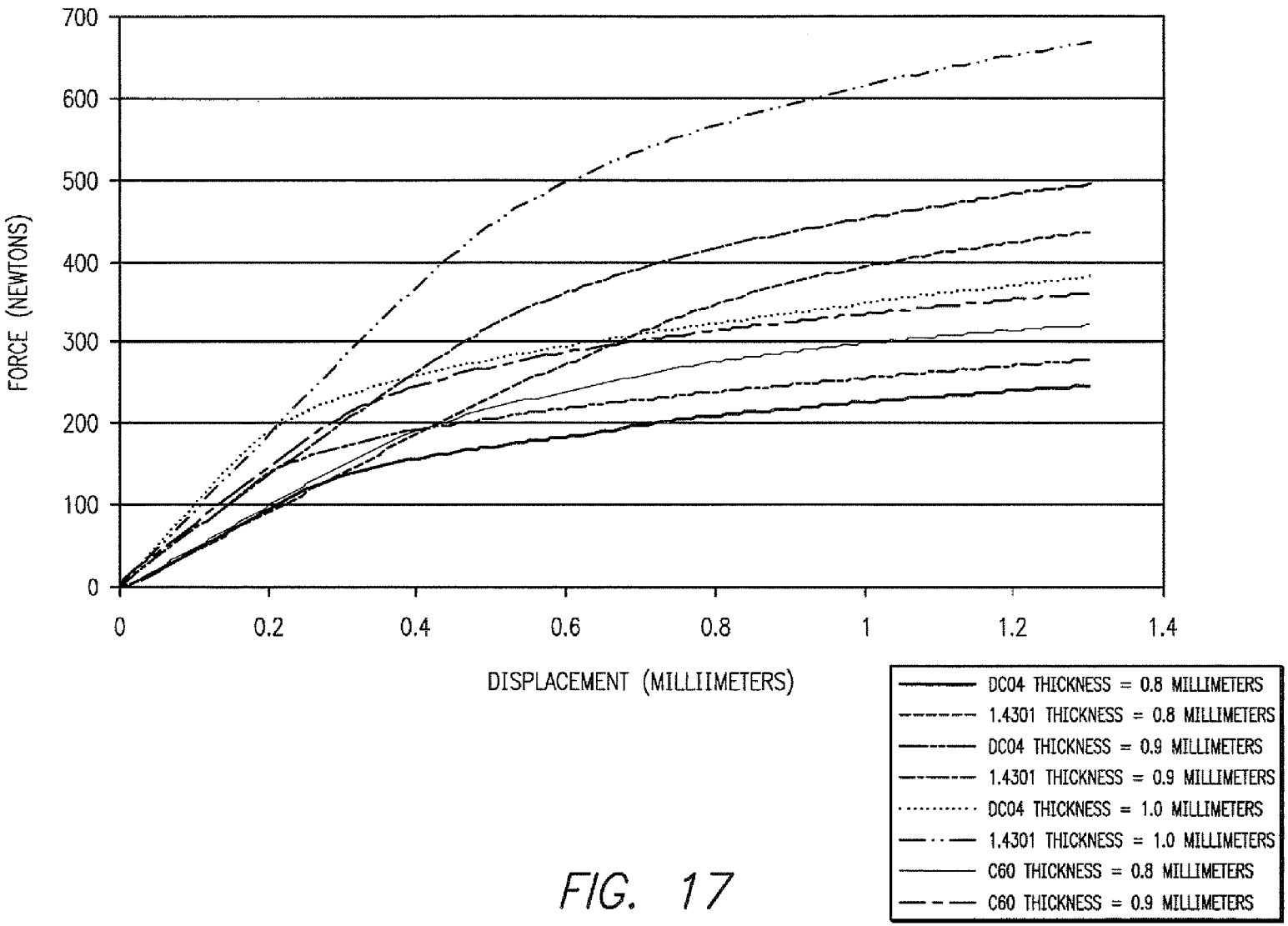
Figure 18:
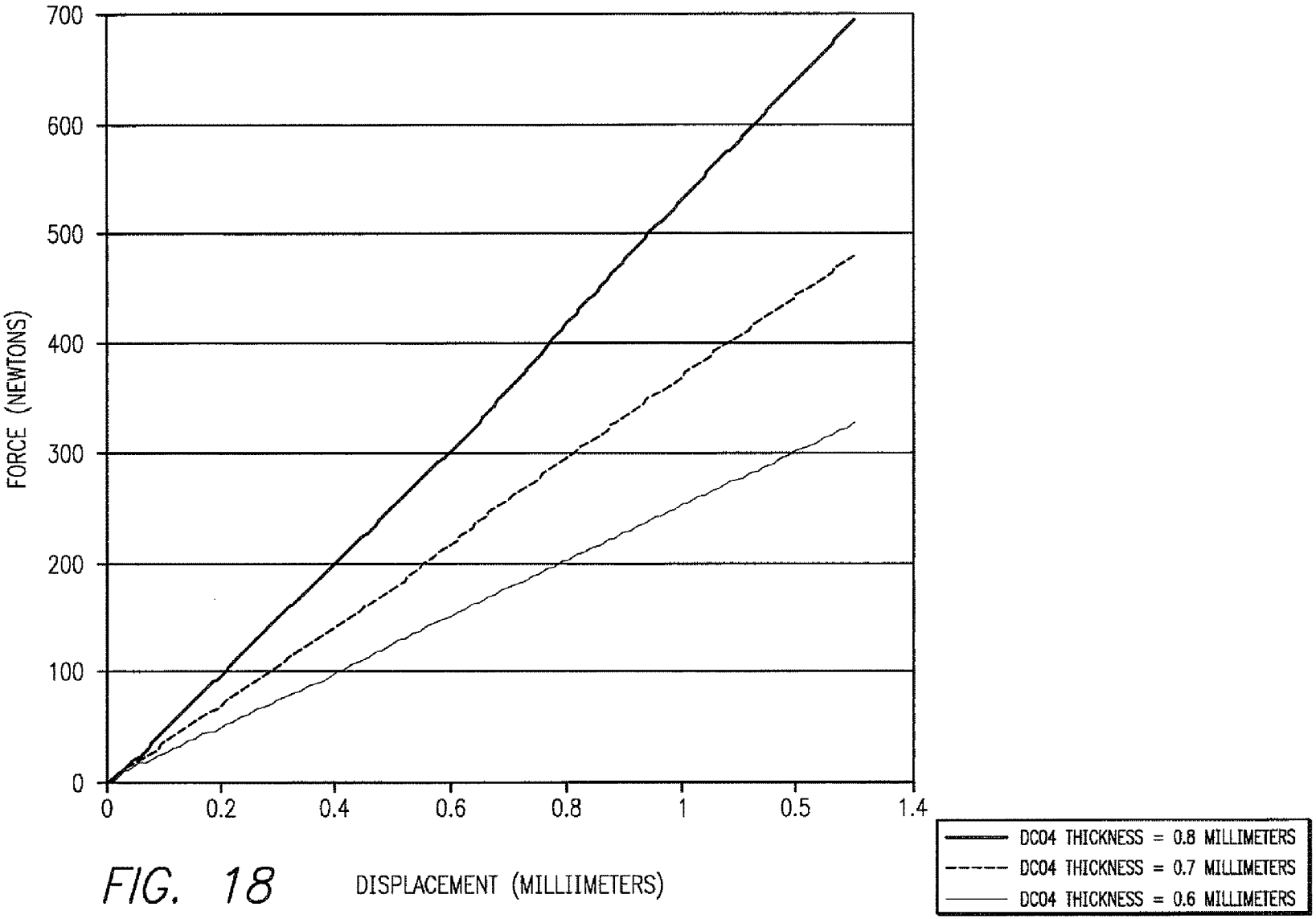

FIG. 11 is a side perspective view (from inside a vehicle) of another exemplary embodiment of an antenna assembly that includes six FAKRA connectors, a claw fastener or mounting claw (broadly, a fastener), and a bayonet locking structure (e.g., pin and slots), where the antenna assembly is illustrated in a pre-mounted position in which the antenna assembly may be temporarily held in place by clips or pre-catch mechanisms engaged with a vehicle body wall after the FAKRA connectors and claw fastener have been inserted through a hexagonal mounting hole in the vehicle body wall into the interior compartment side of the vehicle;

FIG. 12 is a bottom view (from inside the vehicle) of the antenna assembly shown in FIG. 11;

FIG. 13 is a bottom view (from inside the vehicle) illustrating the antenna assembly shown in FIGS. 11 and 12 but now mounted and installed to the vehicle body wall by way of the claw fastener having been rotated such that the claw fastener and antenna assembly apply a compressive clamping force therebetween to the vehicle body wall;

FIG. 14 is a side view illustrating an exemplary FAKRA connector mounting frame that may be placed directly on a printed circuit board such that the printed circuit board, frame, and antenna base or chassis may be mechanically fastened (e.g., screwed, bolted, etc.) together according to an exemplary embodiment;

FIG. 15 is a side perspective of an exemplary FAKRA connector mounting frame including fastener holes (e.g., screw holes on mounting latches, eyelets, flanges, etc.) according to an exemplary embodiment;

FIG. 16 is an exemplary line graph of axial force (in Newtons) versus axial displacement or movement (in millimeters) force and illustrating maximum elasticity, where the data was obtained via finite element model (FEM) analysis involving a model representative of the claw fastener shown in FIGS. 1 through 7 made from DC04 steel having a thickness of 0.8 millimeters;

FIG. 17 is an exemplary line graph of force (in Newtons) versus displacement or movement (in millimeters) for different steel materials (DC04, 1.4301, and C60) of different thicknesses (0.8 millimeters, 0.9 millimeter, and 1 millimeter), where the data was obtained via finite element model (FEM) analyses involving models representative of the claw fastener shown in FIGS. 1 through 7; and FIG. 18 is an exemplary line graph of force (in Newtons) versus displacement or movement (in millimeters), where the data was linearly calculated using finite element model (FEM) analyses involving models representative of the claw fastener shown in FIGS. 1 through 7 and made from DC04 steel having three different thicknesses of 0.6 millimeters, 0.7 millimeters, and 0.8 millimeters.

Corresponding reference numerals indicate corresponding parts throughout the several views of the drawings.

DETAILED DESCRIPTION

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

According to various aspects, exemplary embodiments are provided of antenna mounting devices, mounting methods, and antenna assemblies. Various exemplary embodiments include a fastener (e.g., claw fastener, mounting claw, etc.) for mounting an antenna assembly, module, or component (e.g., chassis, amplifier chassis, etc.) to a mounting surface, such as a vehicle body wall (e.g., a vehicle's roof, hood, trunk lid, etc.), surface of another antenna component, etc. In such examples, the fastener may be attachable to a portion or surface of an antenna module, assembly, or component. The fastener may include (e.g., integrally include, have attached thereto, etc.) or be configured to interact with an actuator (e.g., guide/frictional/threaded clamping actuator, etc.), which in some embodiments comprises a pin that slides or moves within one or more grooves or slots. The one or more grooves or slots may be provided or integrally defined by the fastener, by a mounting surface, and/or by an intermediate structure attached to the mounting surface. During installation, the actuator helps generate, for example, static frictional, compressive clamping between the fastener and the mounting surface. The fastener may also include or be configured to interact with a locking structure.

Various exemplary embodiments include a bayonet locking structure that includes a pin and slots or grooves. Further, the actuator may cause a static frictional, compressive clamping between (i) the fastener, (ii) the mounting surface of the antenna module, assembly, or component, and (iii) a second mounting surface (e.g., vehicle body wall, etc.). The installation process may include the actuator converting a rotational force into a perpendicular clamping force. In various exemplary embodiments, a pin traveling in one or more grooves or slots causes movement of the fastener as the fastener is rotated, where that movement is generally vertical or perpendicular to the rotational movement. In various embodiments, the fastener may comprise a claw fastener or mounting claw having a central hub from which extends one or more flange portions, legs, or fingers having claw portions.

In an exemplary embodiment, an antenna module or assembly is configured to be installed and fixedly mounted to a vehicle body wall after being inserted into a mounting hole in the vehicle body wall from an external side of the vehicle and then nipped from the interior compartment side. The antenna assembly generally includes an antenna base or chassis configured to be disposed along an external side of the vehicle with respect to the vehicle body wall. The antenna assembly also includes a printed circuit board, which may be at least partially supported by the chassis. One or more electrical connectors (e.g., FAKRA connector, ISO (International Standards Organization) standard connector, etc.) may be electrically coupled to the printed circuit board. The one or more electrical connectors may extend through corresponding openings in the chassis. Prior to installation or mounting of the antenna assembly to a vehicle body wall, a fastener may be coupled to the antenna assembly as follows.

A central portion or hub of the fastener may be positioned generally over a protruding portion or nub of the chassis, such that slots or grooves of the fastener are aligned with openings through the nub of the chassis. A pin may be inserted into the fastener's slots or grooves and the nub's openings. At this pre-mounted stage, the pin retains the fastener to the antenna assembly by virtue of the pin being lodged within the openings of the chassis' nub and within the fastener's slots or grooves. In some embodiments, an interference or friction fit may also be formed between the fastener's hub and the nub of the chassis to help further retain the fastener to the chassis.

With the fastener coupled to the antenna assembly, the antenna assembly may then be positioned from outside the vehicle along the external side of the vehicle. The positioning of the antenna assembly may also include inserting the fastener and electrical connectors at least partially through a mounting hole in the vehicle body wall, such that the fastener and electrical connectors are accessible from inside the vehicle. Accordingly, the end portions of the electrical connectors and fastener are thus disposed on the interior compartment side of the vehicle, while the chassis and printed circuit board are disposed on the external side of the vehicle body wall.

From inside the vehicle, an installer may then rotate the fastener, such as by using a suitable tool (e.g., Allen or hex-head wrench, wrench, screwdriver, etc.). In some embodiments disclosed herein, the rotation of the fastener causes the pin to travel or slide within the bayonet locking slots of the fastener. This, in turn, causes the fastener to move in a direction (e.g., vertically or generally perpendicular to the rotation, etc.), such that the fastener's clamping portion (e.g., fingers, legs, flange portions, teeth, etc.) moves generally towards the vehicle body wall. The rotation of the fastener also rotates the fastener's clamping portion from a first position or orientation within the mounting hole to a second position or orientation overlaying or overlapping the vehicle body wall. The combined rotation and movement repositions the fastener's clamping portion from an unclamped position within the mounting hole to a clamped position abutting against the vehicle body wall. In the clamped position, the antenna assembly is thus mounted to the vehicle body wall by a compressive clamping force applied to the vehicle body wall generally between and by the interaction of the fastener and the chassis. In addition, the movement of the fastener may also forcibly insert the chassis' nub into the hollow hub of the fastener, which, in turn, may create a frictional or interference fit between the fastener and the chassis' nub. This frictional or interference fit between the fastener and the nub of the chassis may help provide a relatively good attachment or snug fit of the fastener to the chassis.

In some embodiments, the fastener's clamping portion may be configured (e.g., provided or formed with claws or claw portions, etc.) to scratch the vehicle body wall when the fastener is rotated. The scratches may help provide good electrical grounding contact with the vehicle body wall.

In various embodiments, the fastener essentially operates as a spring element for creating the compressive clamping force for mounting the antenna assembly to the vehicle body wall. The fastener may be configured so as to not experience plastic deformation during use. By way of example only, a claw fastener, mounting claw, or fastener disclosed herein may be made of metal, alloy, or other suitable material(s) that will not be permanently deformed due to the stress imparted thereon from the installation process. Exemplary materials out of which a claw fastener, mounting claw, or fastener disclosed herein may be made include stainless steel, DC04 steel, austenitic stainless steel 1.4301, C60 steel, etc. A claw fastener, mounting claw, or fastener disclosed herein may be made out of a material(s) having a thickness falling within a range from about 0.6 millimeter to about 1 millimeter, e.g., 0.6 millimeter thickness, 0.7 millimeter thickness, 0.8 millimeter thickness, 0.9 millimeter thickness, 1 millimeter thickness, etc. Alternative embodiments may include the use of other materials having other dimensions. The particular materials and dimensions disclosed in this paragraph and elsewhere herein are provided for purposes of illustration only and should not be considered limiting.

Other aspects relate to methods of installing antenna modules, assemblies, or components to mounting surfaces, such as a vehicle body wall having external and internal sides with a mounting hole therebetween. In some exemplary embodiments, a method generally includes positioning an antenna assembly relative to a mounting hole from an external side of the vehicle body wall, such that the chassis is disposed along the external side of the vehicle body wall and such that a fastener and one or more electrical connectors are accessible from the internal side of the vehicle body wall. The method may also include (from inside the vehicle) rotating the fastener (e.g., using an Allen or hex-head wrench, wrench, socket wrench, screwdriver, pliers, other suitable tool, etc.) such that a pin travels or slides within the fastener's slots, thus causing the fastener to move in a direction such that the fastener's clamping portion (e.g., fingers, legs, flange portions, etc.) moves generally towards the vehicle body wall. The rotation of the fastener also rotates the fastener's clamping portion from a first position or orientation within the mounting hole to a second position or orientation overlaying or overlapping the vehicle body wall. The combined rotation and movement of the fastener repositions the fastener's clamping portion from an unclamped position within the mounting hole to a clamped position abutting against the vehicle body wall. In the clamped position, the antenna assembly is thus mounted to the vehicle body wall by a compressive clamping force applied to the vehicle body wall generally between and by the interaction of the fastener and the chassis.

Other aspects relate to apparatus and methods for mounting antenna components, such as amplifiers, etc. In one exemplary embodiment, an amplifier includes an amplifier chassis having bayonet locking slots or grooves. A fastener includes openings that may be aligned with the bayonet locking slots when the fastener is engagingly received within a passage of the amplifier chassis. With the fastener's openings respectively aligned with the bayonet locking slots of the amplifier chassis, a pin may be received within the fastener's openings and the bayonet locking slots of the amplifier chassis. At this pre-mounted stage, the pin retains the amplifier chassis to the fastener by virtue of the pin being lodged within the openings of the fastener and within the bayonet locking slots of the amplifier chassis. The amplifier chassis (with the fastener pre-mounted and retained thereto by the engagement of the pin within the slots and openings) may then be positioned as a single unit relative to a mounting hole in a mounting surface, such that the fastener's clamping portion extends through the mounting hole. The fastener may then be rotated by using a suitable tool (e.g., Allen wrench, socket wrench, wrench, screwdriver, pliers, etc.). With the rotation of the fastener, the pin travels or slides within the bayonet locking slots, which, in turn, causes the fastener to move in a direction (e.g., generally vertical or perpendicular to the rotation, etc.) such that the fastener's clamping portion (e.g., fingers, legs, rectangular flange portion, etc.) moves generally towards the mounting surface. The rotation of the fastener also rotates the fastener's clamping portion from a first position or orientation within the mounting hole to a second position or orientation overlaying or overlapping the vehicle body wall. The combined rotation and movement repositions the fastener's clamping portion from an unclamped position within the mounting hole to a clamped position abutting against the mounting surface. In the clamped position, the amplifier chassis is thus mounted to the mounting surface by a compressive clamping force applied to the mounting surface generally between and by the interaction of the fastener and the amplifier chassis. In addition, the movement of the fastener may also forcibly insert the fastener's upper portion (which may be tapered and increase in size from top to bottom) into the passage of the amplifier chassis. This, in turn, may create a frictional or interference fit between the fastener and the amplifier chassis, which may help provide a relatively good attachment or snug fit of the fastener to the amplifier chassis.

Accordingly, exemplary embodiments of the present disclosure include a fastener (e.g., claw fastener, mounting claw, etc.) that may be used for mounting an antenna module, assembly, or component to a mounting surface (e.g., vehicle body wall, etc.). In some embodiments, the fastener may be relatively compact in size and be pre-mounted with a pin-slot bayonet locking structure before mounting of the antenna module, assembly, or component to a mounting surface. The bayonet locking structure may allow for a reduced installation time and allow an installer to mount the antenna module, assembly, or component using only one hand (e.g., the hand holding the Allen wrench, socket wrench, pliers, wrench, screwdriver, or other suitable tool to rotate the fastener, etc.). In various embodiments, a fastener is a pre-mounted part of the antenna component, assembly, or module, such that no additional, separate parts are needed on the production line for mounting the antenna assembly, module, or component, thus facilitating the mounting process on the production line.

Figure 1:
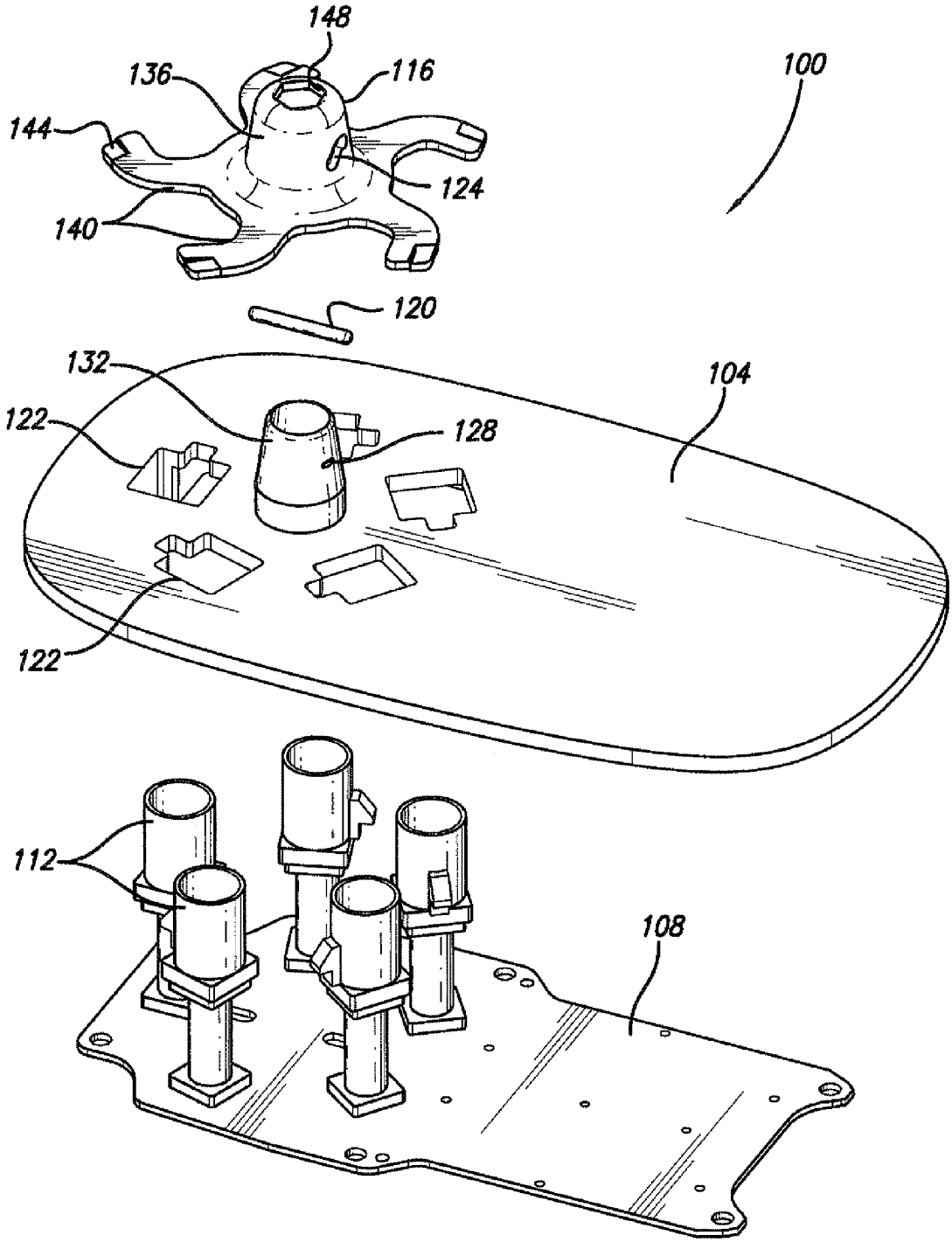
FIG. 1 is an exploded perspective view of an antenna assembly, and illustrating a claw fastener or mounting claw (broadly, a fastener) and a bayonet locking structure (e.g., pin and slots), which may be used for mounting the antenna assembly to a vehicle body wall, according to an exemplary embodiment of the present disclosure.
Figure 2:
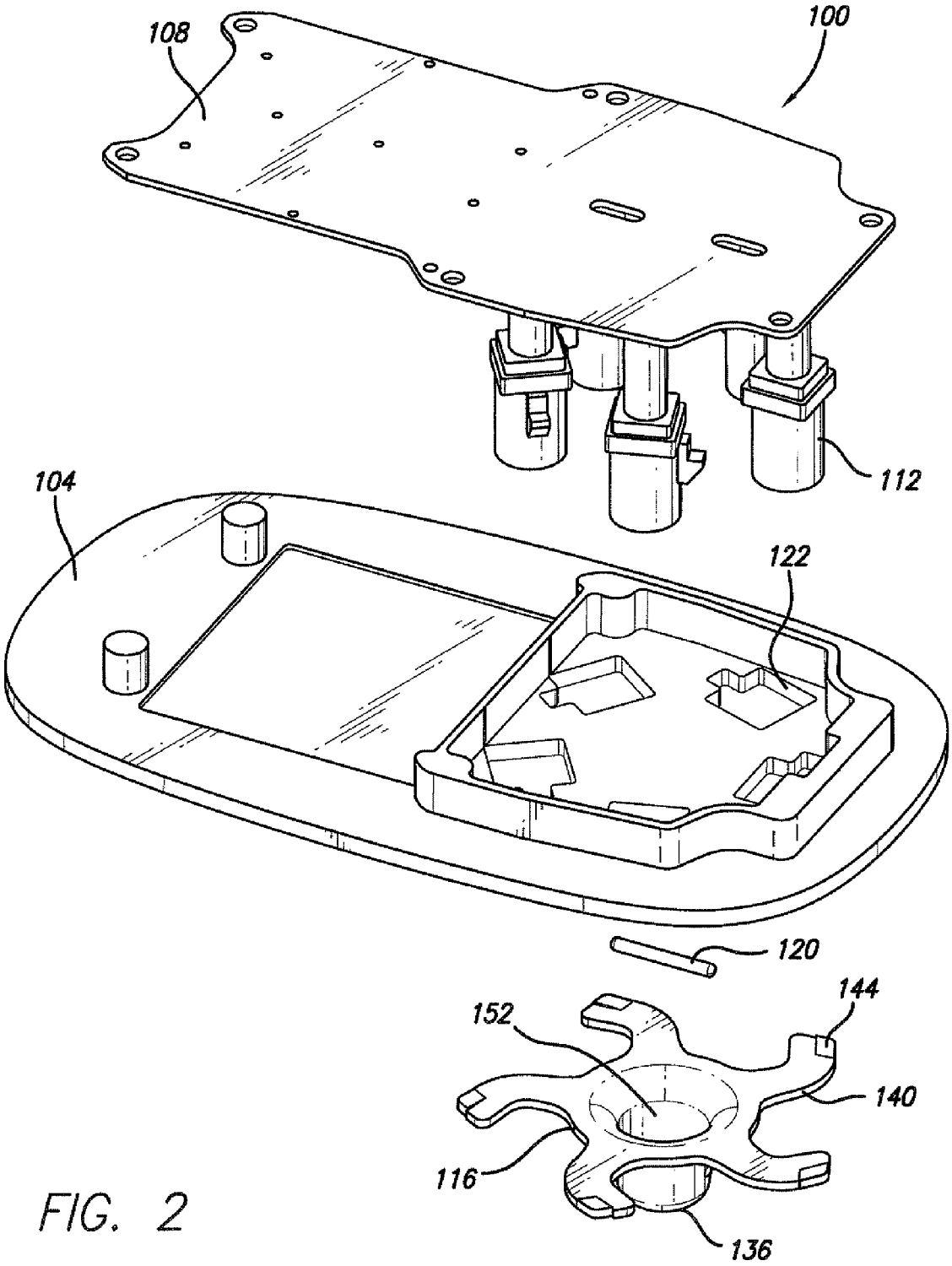
FIG. 2 is another exploded perspective view of the antenna assembly shown in FIG. 1.

FIGS. 1 and 2 illustrate an antenna assembly 100 embodying one or more aspects of the present disclosure. As shown, the antenna assembly 100 includes a chassis or base 104, a printed circuit board 108, and electrical connectors 112. This particular embodiment also includes a claw fastener or mounting claw 116 (broadly, a fastener) and a guiding pin or bayonet 120. The claw fastener 116 and pin 120 may be used for mounting the antenna assembly 100 to a vehicle body wall 130 (FIGS. 3 and 4) (e.g., vehicle roof, hood, trunk lid, etc.) or other suitable mounting surface as disclosed herein.

The antenna assembly 100 includes five connectors 112 that are configured to be positioned through corresponding openings 122 in the chassis 104. In this illustrated embodiment, the connectors 112 comprise FAKRA connectors, which are designed as coaxial connectors comprising a dielectric and an outer conductor around an inner conductor. Alternative embodiments may include more or less than five connectors and/or different connectors besides FAKRA connectors, such as one or more ISO (International Standards Organization) standard electrical connector, etc. depending, for example, on the particular vehicle and/or application intended for the antenna assembly 100. By way of example, FIGS. 11 through 13 illustrate an exemplary embodiment that includes six FAKRA connectors 312.

Figure 3:
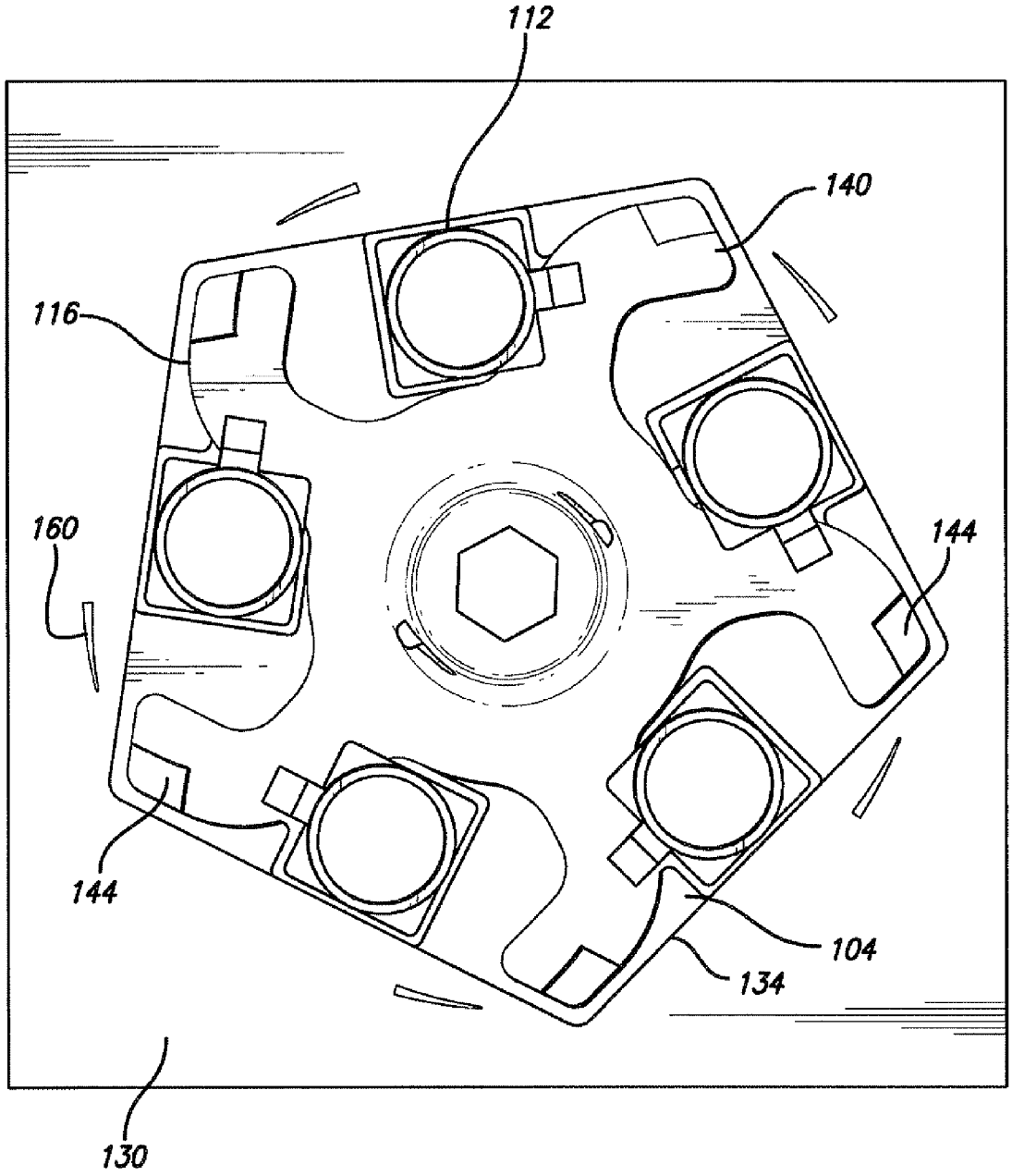
FIG. 3 is a bottom view of the antenna assembly shown in FIGS. 1 and 2 and illustrating (from inside a vehicle) the antenna assembly in a pre-mounted position in which the FAKRA connectors and claw fastener have been inserted through a pentagonal mounting hole in a vehicle body wall into the interior compartment side of the vehicle.
Figure 4:
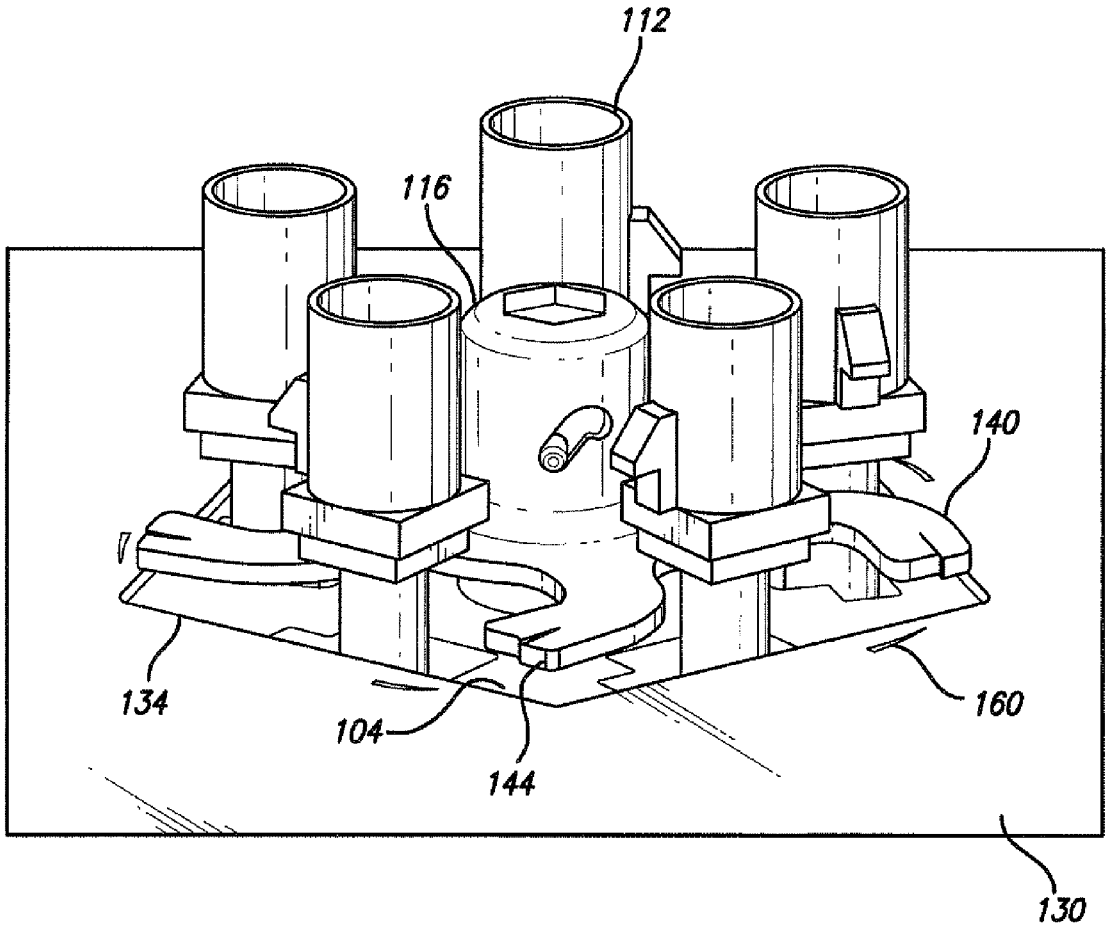
FIG. 4 is a side perspective view (from inside the vehicle) of the antenna assembly shown in FIG. 3, and further illustrating the positioning of the claw fastener and FAKRA connectors relative to the vehicle body wall and mounting hole.
Figure 5:
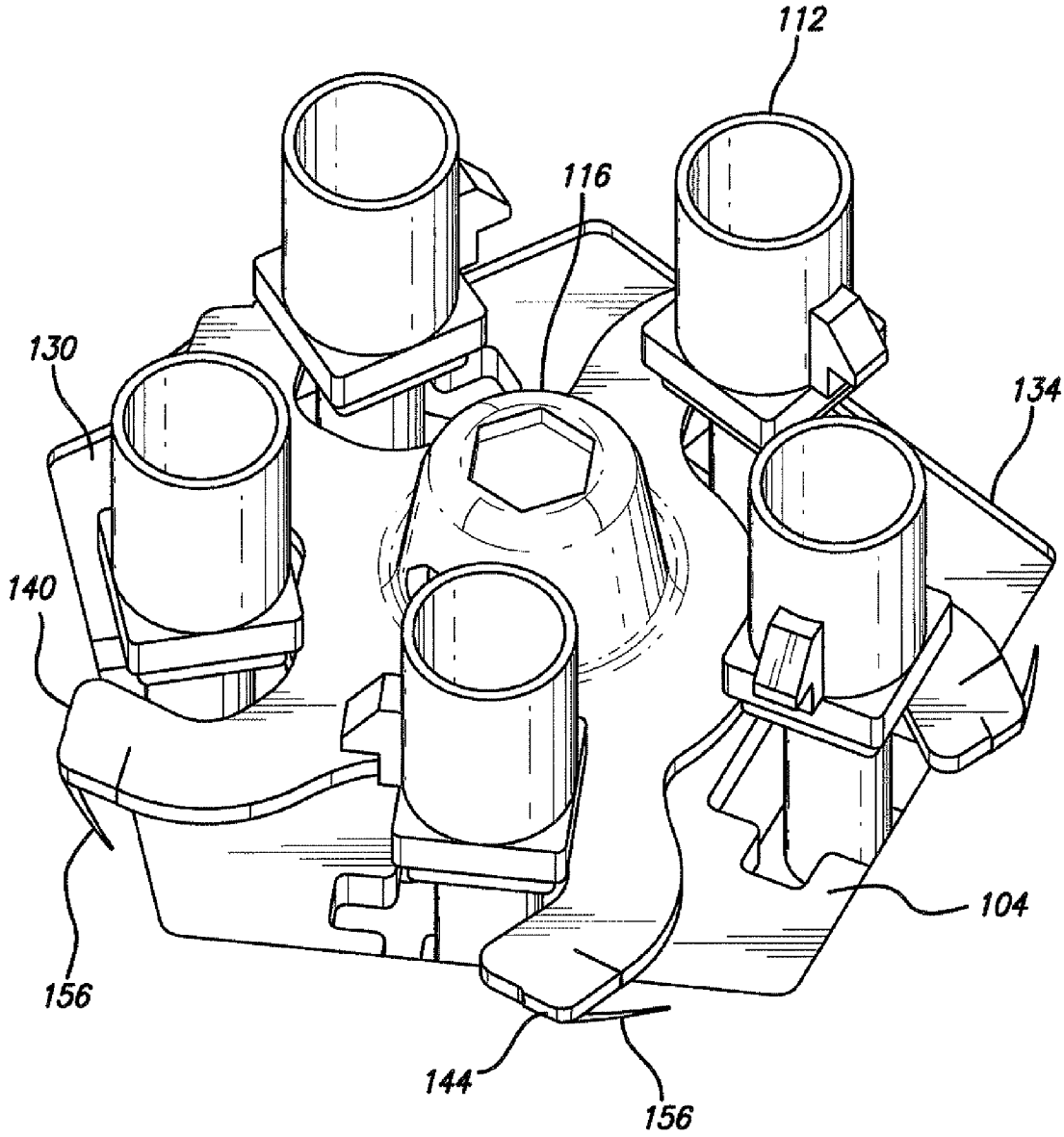
FIG. 5 is a side perspective view (from inside the vehicle) illustrating the antenna assembly shown in FIG. 4 but now mounted and installed to the vehicle body wall by way of the claw fastener having been rotated such that the claw fastener and antenna assembly apply a compressive clamping force therebetween to the vehicle body wall.

With continued reference to FIG. 1, the pin 120 is configured to be slidably received within first and second slots or grooves 124 of the claw fastener 116. The pin 120 is also configured to be engagingly received within openings 128 of a portion or nub 132 protruding generally outwardly from the chassis 104. By positioning the pin 120 within the slots 124 and openings 128, the claw fastener 116 may thus be retained and pre-mounted to the antenna assembly 100 before the antenna assembly 100 is positioned relative to or mounted to the vehicle body wall 130 (FIGS. 3, 4, and 5). Accordingly, the antenna assembly 100 (with the claw fastener 116 pre-mounted and retained thereto by the pin 120) may be positioned as a single unit from the external side of the vehicle along the vehicle body wall 130 such that the claw fastener 116 and FAKRA connectors 112 extend through the mounting hole 134. At which point, an installer inside the vehicle may access the claw fastener 116 and FAKRA connectors 112. In this exemplary embodiment, the mounting hole 134 has a pentagonal shape with a diameter of about 43 millimeters. Alternative embodiments may be used with mounting holes having different configurations, such as a different shape (e.g., hexagonal mounting hole (FIGS. 11 through 13), rectangular mounting hole, etc.), a different size (e.g., diameter greater or less than 43 millimeters), etc. The particular configuration of mounting hole may depend, for example, on the particular features of the antenna assembly to be installed, such as the number and type of electrical connectors, number of legs or fingers of the claw fastener or mounting claw, etc.

Figure 6:
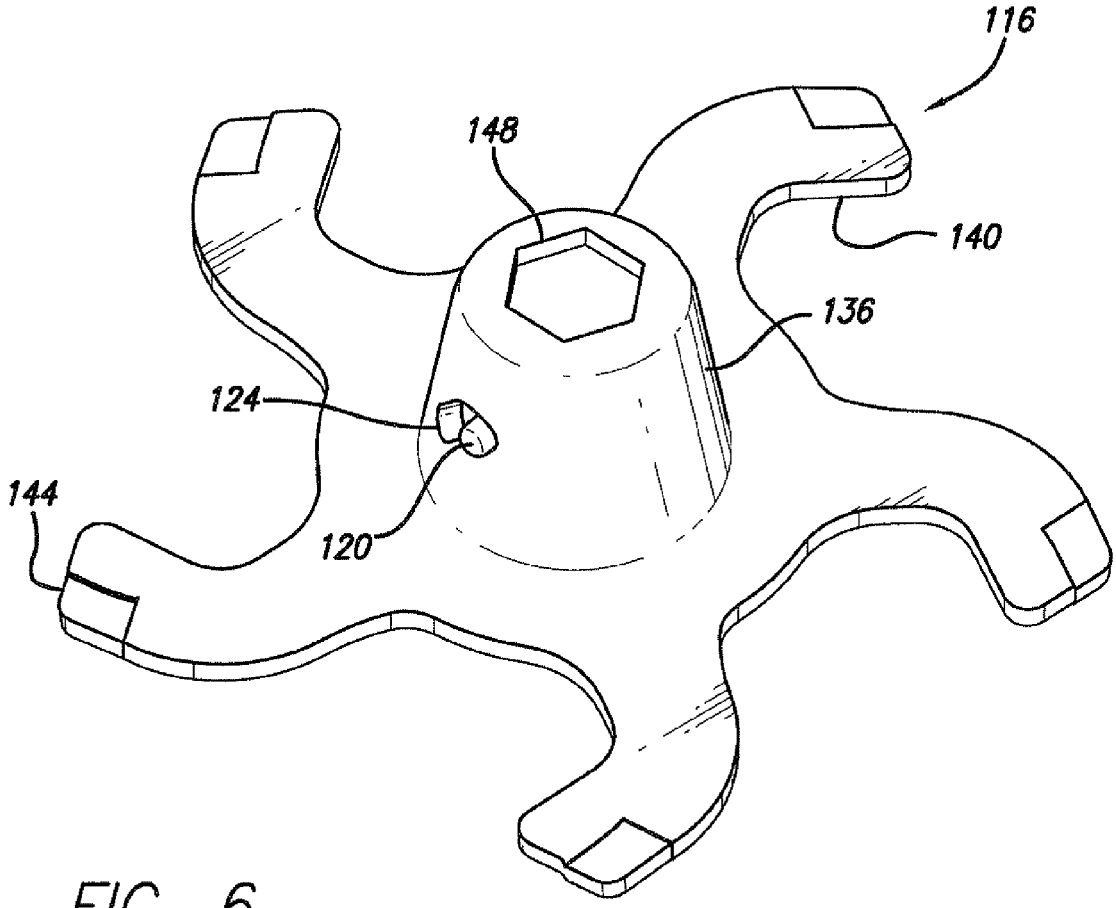
FIG. 6 is a perspective view of the claw fastener shown in FIG. 5 and illustrating the pin within the slot of the claw fastener in the installed position after rotation of the claw fastener.
Figure 7:
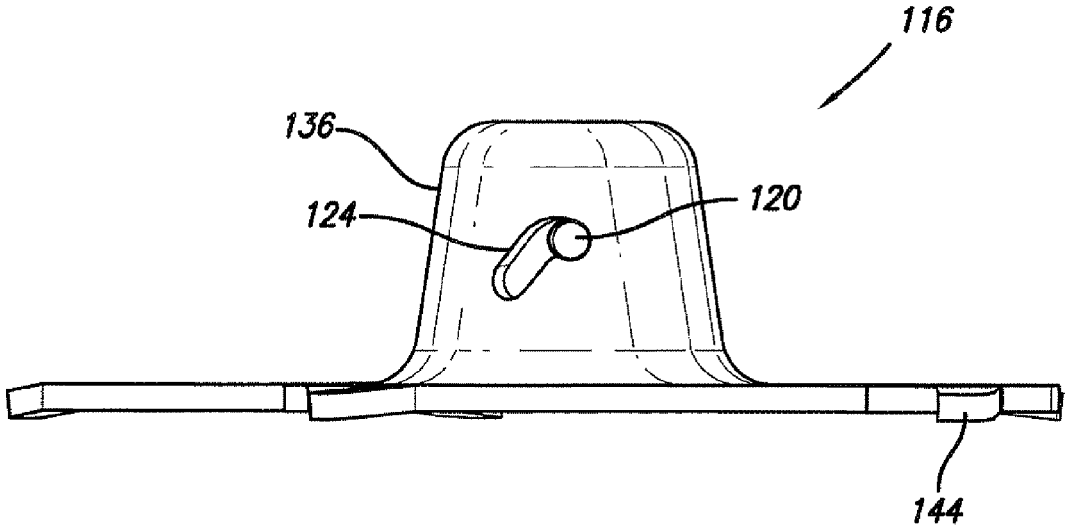
FIG. 7 is a side view of the claw fastener and pin shown in FIG. 6.

As shown in FIGS. 6 and 7, this illustrated embodiment of the claw fastener 116 includes a central hub or portion 136. The hub 136 has a generally rounded or ogival shaped upper portion. The hub 136 is tapered such that it increases in size (e.g., increases in diameter and circumference, etc.) from its free end portion (the top end portion shown in FIG. 7) to its other end portion (the lower end portion shown in FIG. 7). As shown in FIG. 2, the hub 136 is generally hollow and has an opening 152. The opening 152 is configured for engagingly receiving the nub 132 (FIG. 1) of the chassis 104. The opening 152 into the hub 136 may be tapered to facilitate the insertion of the nub 132 of the chassis 104 into the hub 136 of the claw fastener 116.

Figure 8:
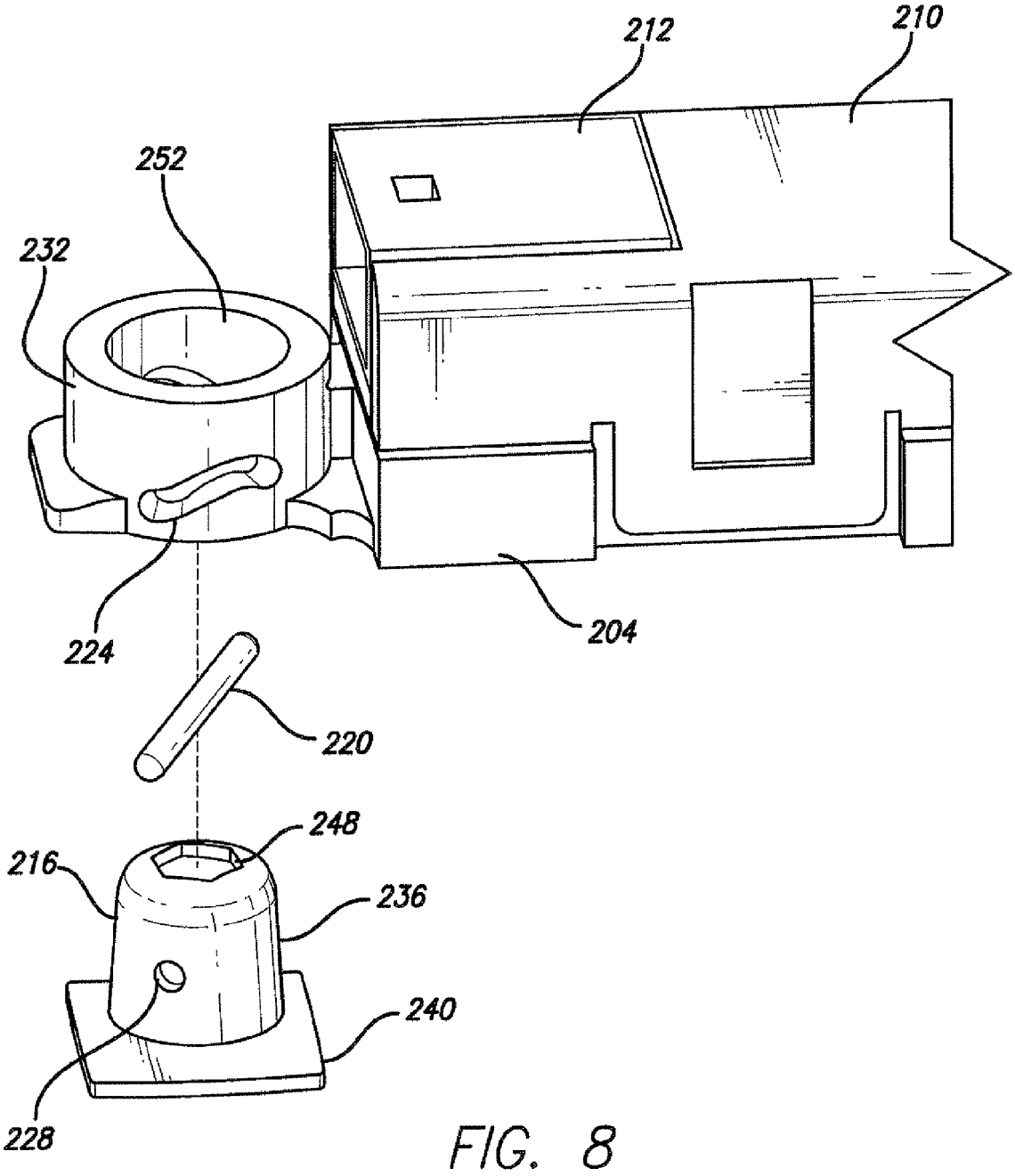
FIG. 8 is an exploded perspective view of an antenna amplifier assembly and a pin and fastener that may be used for mounting the antenna amplifier assembly to a mounting surface, according to another exemplary embodiment of the present disclosure.
Figure 9:
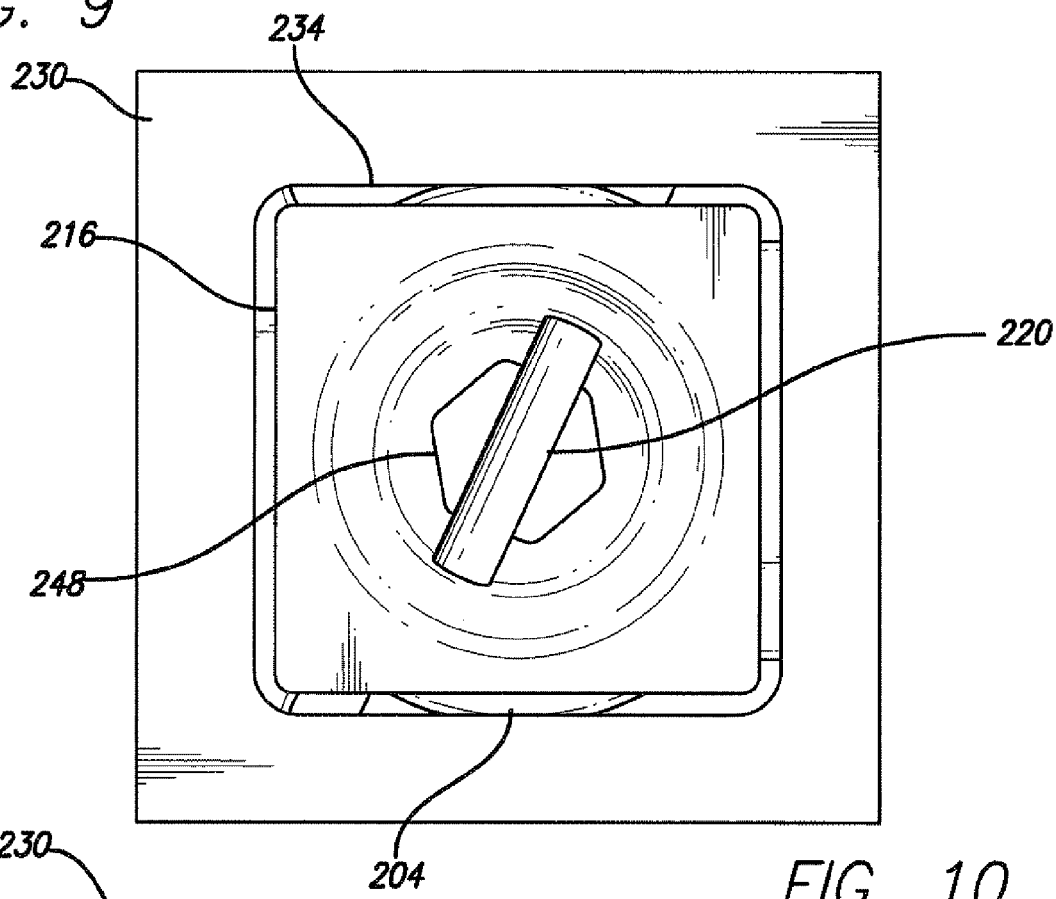
FIG. 9 is a bottom view showing the pin engaged with openings of the fastener and bayonet locking slots of the amplifier chassis in a pre-mounted configuration relative to the mounting surface.
Figure 10:
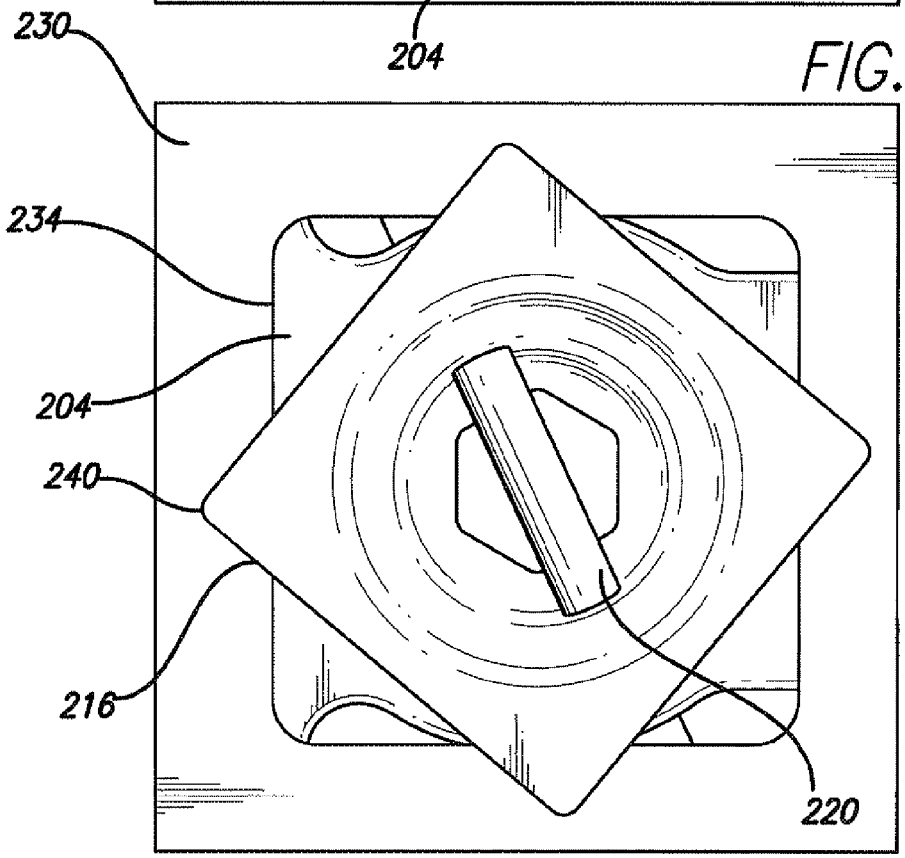
FIG. 10 is a bottom view showing the pin engaged with the openings of the fastener and bayonet locking slots of the amplifier chassis shown in FIG. 9 but now mounted and installed to the mounting surface by way of the fastener having been rotated such that the fastener and amplifier chassis apply a compressive clamping force therebetween to the mounting surface.

In addition, the claw fastener 116 includes a clamping portion defined by five fingers or legs 140 that extend outwardly from the hub 136. The five fingers 140 may be dimensionally sized such that the fingers 140 may be inserted freely through the mounting hole 134 with the end portions of the fingers 140 generally aligned with the corners of the pentagonal mounting hole 134. But upon rotation of the claw fastener 116, the fingers 140 may be rotated from a first position or orientation relative to mounting hole 134 (FIGS. 3 and 4) to a second position or orientation in which the end portions of the fingers 140 overlap or overlay the vehicle body wall 130 (FIG. 5). In various embodiments, the mounting hole 134 and/or fingers 140 may be relatively sized dimensionally such that the fingers 140 overlap/overlay the vehicle body wall 130 and extend outwardly beyond the mounting hole 134 by a distance within a range of about 2 millimeters to about 3 millimeters (e.g., 2 millimeters, 2.5 millimeters, 3 millimeters, etc.). Alternative embodiments may be configured such that the fingers of the claw fastener extend or overlap the vehicle body wall by a distance greater than 3 millimeters or less than 2 millimeters. Additional embodiments may include more or less than five fingers 140, such as a fastener having only four fingers. As another example, FIGS. 8 through 10 illustrate a fastener 216 having a clamping portion 240 that is generally rectangular and that does not include any outwardly extending fingers or legs, but instead includes a re. As a further example, FIGS. 11 through 13 illustrate a claw fastener or mounting claw 316 having six legs or fingers 340. Further embodiments may include fasteners with clamping portions in different configurations (e.g., different shapes, different sizes, etc.).

In the illustrated embodiment of FIGS. 1 through 7, the claw fastener's fingers 140 are configured with (e.g., provided with, integrally formed with, or have attached thereto claws or claw portions 144, etc.) so as to scratch the vehicle body wall 130 when the claw fastener 116 is rotated (e.g., clockwise rotation in FIGS. 3 through 5, etc.). For this embodiment, each finger 140 includes a claw or claw portion 144. Accordingly, the fastener 116 of this embodiment is generally referred to as a claw fastener or mounting claw for purposes of illustration only. FIG. 5 shows scratches 156 made by the claw portions 144 after rotation of the claw fastener 116 clockwise from the position shown in FIG. 4 to the position shown in FIG. 5. FIGS. 3 and 4 show locations 160 at which the scratches 156 will occur for purposes of comparison and illustration only, as the scratches 156 are formed by the claw portions 144 when the claw fastener 116 is rotated clockwise to the position shown in FIG. 5. The scratches 156 may help provide good electrical grounding contact between the claw fastener 116 and the vehicle body wall 130. Alternative embodiments may include fasteners without any clawing portions, fasteners have more or less claw portions (e.g., more than one claw portion per finger, etc.), and/or fasteners with other means for scratching the vehicle body wall.

In some embodiments, the claw fastener 116 essentially operates as a spring element and is configured so as to not experience plastic deformation during use. By way of example only, the claw fastener 116 may be made of metal or other suitable material that will not be permanently deformed due to the stress imparted thereon from the installation process. Exemplary materials out of which the claw fastener or mounting claw 116 may be made include stainless steel, DC04 steel, austenitic stainless steel 1.4301, C60 steel, etc. The claw fastener or mounting claw 116 may be made out of a material(s) having a thickness falling within a range from about 0.6 millimeter to about 1 millimeter, e.g., 0.6 millimeter thickness, 0.7 millimeter thickness, 0.8 millimeter thickness, 0.9 millimeter thickness, 1 millimeter thickness, etc. Alternative embodiments may include the use of other materials having other dimensions for the claw fastener or mounting claw 116. The particular materials and dimensions disclosed in this paragraph and elsewhere herein are provided for purposes of illustration only and should not be considered limiting.

With continued reference to FIG. 1, the claw fastener 116 includes a tool reception site, more specifically, a hexagonal socket, hole, or opening 148 in this embodiment, which allows an installer to more easily rotate the claw fastener 116 by using a suitable tool (e.g., Allen wrench, other suitable tool, etc.). Alternatively, the claw fastener 116 may include a tool reception site with a different configuration compatible with a different tool, such as a slot compatible with a regular screw driver, an opening compatible with a Philips screwdriver, or a portion (e.g., hexagonal head portion, etc.) compatible to be engaged with a wrench, etc. Other embodiments may be configured such that a mechanical fastener (e.g., bolt, screw, etc.) may be inserted into an opening, socket, or hole of the claw fastener, which mechanical fastener may then be rotated to rotate the claw fastener. In still further embodiments, a claw fastener may include (e.g., integrally include, have attached thereto, be provided with, etc.) a mechanical fastener (e.g., fixation bolt, screw, etc.) such that the mechanical fastener is part of the claw fastener itself. In some of these alternative embodiments, the mechanical fastener may be threadedly engaged to a threaded portion of the antenna chassis, such as threads within a portion (e.g., nub 132 of FIG. 1, etc.) of an antenna chassis. A tool may be used for rotating the mechanical fastener and claw fastener. In some embodiments in which a mechanical fastener (e.g., bolt, etc.) is used for rotating the claw fastener, a bayonet locking structure (e.g., pin and slots, etc.) may still be used to retain and pre-mount the claw fastener to the antenna assembly as well as for helping cause the claw fastener to move towards the vehicle body wall when rotated. In alternative embodiments in which a mechanical fastener is used for rotating the claw fastener, the antenna assembly may be configured (e.g., include threaded connections between the mechanical fastener and another portion of the antenna assembly, etc.) such that the mechanical fastener may be used to retain and pre-mount the claw fastener to the antenna assembly as well as for causing the claw fastener to move towards the vehicle body wall when rotated.

Referring now to FIGS. 1 through 5, an exemplary installation process will now be described for the antenna assembly 100. The printed circuit board 108 may be positioned relative to the chassis 104 such that the FAKRA connectors 112 extend through the openings 122 of the chassis 104. The claw fastener 116 may be positioned relative to the chassis 104, such that the nub 132 of the chassis 104 is received within the opening 152 of the claw fastener's hub 136 and such that the chassis' openings 128 are aligned with the bayonet locking slots 124 of the claw fastener 116. The pin 120 may then be positioned within the slots 124 and openings 128, to thereby retain and pre-mount the claw fastener 116 to the chassis 104. The antenna assembly 100 (with the claw fastener 116 pre-mounted or retained thereto by the engagement of the pin 120 within the slots 124 and openings 128) may then be positioned (from outside the vehicle) as a single unit relative to the mounting hole or cutout portion 134 of the vehicle body wall 130, such that the antenna assembly 100 is along the vehicle body wall 130 and the fastener 116 and FAKRA connectors 112 extend through the mounting hole 134 and are accessible from inside the vehicle. Accordingly, the installer from inside the vehicle may then use a tool to rotate the claw fastener 116. With the rotation of the claw fastener 116, the pin 120 travels or slides within the bayonet locking slots 124. This, in turn, causes the claw fastener 116 to move in a direction generally vertical or perpendicular to the rotation, such that the claw fastener's fingers 140 moves generally towards the vehicle body wall 130. The rotation of the claw fastener 116 also rotates the claw fastener's fingers 140 from a first position or orientation within the mounting hole 134 (FIG. 4) to a second position or orientation overlapping or overlaying the vehicle body wall 130 (FIG. 5). In addition, scratches 156 may be made by the claw portions 144 during the rotation of the claw fastener 116 as shown in FIG. 5. The combined rotation and movement of the claw fastener 116 repositions the claw fastener's legs 140 from an unclamped position within the mounting hole 134 to a clamped position abutting against the vehicle body wall 130. In the clamped position, the antenna assembly 100 is thus mounted to the vehicle body wall 130 by a compressive clamping force applied to the vehicle body wall 130 generally between and by the interaction of the claw fastener 116 and the chassis 104.

In addition, the movement of the claw fastener 116 may also forcibly insert the chassis' nub 132 into the opening 152 of the fastener 116. Because the nub 132 of the chassis 104 is tapered and increases in size from its narrower free end portion to its wider base portion, the forcible insertion of the chassis' nub 132 into the claw fastener's opening 152 may create a frictional or interference fit between the claw fastener 116 and the chassis' nub 132. This frictional or interference fit between the claw fastener 116 and the nub 132 of the chassis 104 may help provide a relatively good attachment or snug fit of the fastener 116 to the chassis 104. FIG. 5 illustrates the antenna assembly 100 mounted to the vehicle body wall 130 with the fingers 140 of the fastener 116 deployed against the interior compartment side of the vehicle body wall 130, for clamping the antenna assembly 100 to the vehicle body wall 130.

Also from inside the vehicle, the installer may plug electrical connectors at the ends of communication links (e.g., coaxial cables, etc.) into the antenna assembly's electrical connectors 112. The other ends of the communication links may be electrically connected to other devices, such as a radio receiver, display screen, other suitable devices, etc. Accordingly, the communication links may be used for communicating signals from the antenna assembly 100 to the other devices.

FIGS. 8 through 10 illustrate another exemplary embodiment embodying one or more aspects of the present disclosure. As shown, an amplifier chassis 204 may be mounted to a support surface 230 having a mounting hole 234 (FIGS. 9 and 10) by using a fastener 216 and bayonet locking structure comprising a pin 220 and slots or grooves 224. By way of example, the support surface 230 to which the amplifier chassis 204 may be mounted may comprise any of a wide range of surfaces, such as a surface of another antenna component, a vehicle body wall, etc.

As shown in FIG. 8, a housing 210 and a connector 212 are coupled to the amplifier chassis 204. The connector 212 may be configured to allow one or more of the amplifier components housed within the housing 210 and/or supported by the amplifier chassis 204 to be connected via cabling, wiring, etc. to another device. Alternative embodiments may include different housings and/or different connectors than that which is shown in FIG. 8.

With continued reference to FIG. 8, the fastener 216 includes a first portion 236 and a second or clamping portion 240. The second, clamping portion 240 is generally square with a perimeter edge and corner regions. The corner regions of the clamping portion 240 are disposed outwardly beyond the first portion 236. As shown in FIG. 8, the clamping portion 240 is configured (e.g., sized, shaped, located, etc.) to be positioned through the square mounting hole 234 in the mounting surface 230. And, as shown in FIG. 9, the corner regions of the clamping portion 240 are configured (e.g., sized, shaped, located, etc.) such that the corner regions will be disposed generally under the mounting surface 230 after the fastener 216 has been rotated clockwise from the position shown in FIG. 9 to the position shown in FIG. 10. Alternative embodiments may include a fastener with differently configured clamping portion (e.g., triangular shaped, ovular, rectangular, pentagonal, hexagonal, etc.) depending, for example, on the particular configuration (e.g., shape, size, location, etc.) of the mounting hole. The clamping portion of the fastener may be configured with a perimeter or footprint that substantially matches or corresponds with the perimeter of the mounting hole, such as square, rectangular, triangular, pentagonal, hexagonal, ovular, etc.

As described above, for example, FIGS. 6 and 7 illustrate a fastener 116 having a clamping portion with five legs or fingers 140, which may be inserted through the pentagonal mounting hole 134. As another example (and described below), FIGS. 11 and 13 illustrate a fastener 316 having a clamping portion with six legs or fingers 340, which may be inserted through a hexagonal mounting hole 334.

With continued reference to FIGS. 6 through 8, some embodiments of the fastener 216 may be configured so as to scratch the mounting surface 230 when the fastener 216 is rotated, where the scratching may help provide good electrical grounding contact with the mounting surface 230. In some embodiments, the fastener 216 essentially operates as a spring element and is configured so as to not experience plastic deformation during use. By way of example only, the fastener 216 may be made of metal or other suitable material that will not be permanently deformed due to the stress imparted thereon from the installation process. Exemplary materials out of which the fastener 216 may be made include stainless steel, DC04 steel, austenitic stainless steel 1.4301, C60 steel, etc. The fastener 216 may be made out of a material (s) having a thickness falling within a range from about 0.6 millimeter to about 1 millimeter, e.g., 0.6 millimeter thickness, 0.7 millimeter thickness, 0.8 millimeter thickness, 0.9 millimeter thickness, 1 millimeter thickness, etc. Alternative embodiments may include the use of other materials having other dimensions. The particular materials and dimensions disclosed in this paragraph and elsewhere herein are provided for purposes of illustration only and should not be considered limiting.

As illustrated in FIG. 8, the first portion 236 of the fastener 216 is generally rounded or ogival shaped. The first portion 236 is tapered such that it increases in size from its free end portion (the upper end portion shown in FIG. 8) to its other end portion (the base or lower end portion shown in FIG. 8). The free end portion of the fastener's first portion 236 may also be tapered to facilitate insertion into the passage 252 of the chassis 204.

The fastener 216 includes a hexagonal socket 248 to allow an installer to more easily rotate the fastener 216 by using a suitable tool (e.g., Allen wrench, other suitable tool, etc.). Alternatively, the fastener 216 may include a different configuration compatible with a different tool, such as a slot compatible with a regular screw driver, an opening compatible with a Philips screwdriver, or a portion (e.g., hexagonal head portion, bolt head portion, etc.) compatible to be engaged with a wrench, etc. Other embodiments may be configured such that a mechanical fastener (e.g., bolt, screw, etc.) may be inserted into an opening, socket, or hole of the fastener, which mechanical fastener may then be rotated to rotate the fastener. In still further embodiments, a fastener may include (e.g., integrally include, have attached thereto, be provided with, etc.) a mechanical fastener (e.g., fixation bolt, screw, etc.) such that the mechanical fastener is part of the fastener itself.

The chassis 204 includes a portion 232 that defines the cylindrical opening or passage 252. The passage 252 is configured for engagingly receiving the first portion 236 of the fastener 216. The chassis 204 also includes bayonet locking slots or grooves 224.

In this particular embodiment, the cylindrical passage 252 has a generally circular cross-section with a relatively constant diameter. Alternative embodiments may include an opening or passage with a different cross-section, such as a circular cross-section that decreases in diameter, for example, to provide a stronger friction or interference fit with the first portion 236 of the fastener 216.

The pin 220 is configured to be slidably received within the openings 228 of the fastener 216 and the slots or grooves 224 of the amplifier chassis 204. By positioning the pin 220 within the slots 224 and openings 228, the fastener 216 may thus be retained and pre-mounted to the amplifier chassis 204 before the amplifier chassis 204 is mounted to the mounting surface 230 (FIGS. 9 and 10). Accordingly, the amplifier chassis 204 (with the fastener 216 pre-mounted or retained thereto by the pin 220 being lodged within the slots 224 and openings 228) may be positioned as a single unit relative to the mounting surface 230 such that the fastener's clamping portion 240 extends through the mounting hole 234. In this exemplary embodiment, the mounting hole 234 is generally square. Alternative embodiments may be used with mounting holes having different configurations (e.g., shapes, sizes, location, etc.).

An exemplary installation process will now be described for the amplifier assembly comprising the amplifier chassis 204, housing 210, and connector 212. The fastener 216 may first be positioned relative to the amplifier chassis 204 such that the fastener's first portion 236 is received within the opening 252 of the amplifier chassis 204 and such that the fastener's openings 228 are aligned with the slots 224 of the amplifier chassis 204. The pin 220 may then be positioned within the slots 224 and openings 228, to thereby retain and pre-mount the fastener 216 to the amplifier chassis 204. The amplifier chassis 204 (with the fastener 216 pre-mounted and retained thereto by the engagement of the pin 220 within the slots 224 and openings 228) may then be positioned as a single unit relative to the mounting hole 234 of the mounting surface 230, such that the clamping portion 240 of the fastener 216 extends through the mounting hole 234. An installer may then use a tool (e.g., Allen wrench inserted into the hexagonal socket 248 for the illustrated embodiment, etc.) to rotate the fastener 216 from the position shown in FIG. 9 to the position shown in FIG. 10. With the rotation of the fastener 216, the pin 220 travels or slides within the bayonet locking slots 224 (FIG. 8). This, in turn, causes the fastener 216 to move in a direction generally perpendicular to the rotation (e.g., upward in FIG. 8 or into the page in FIGS. 9 and 10), such that the fastener's clamping portion 240 moves generally towards the mounting surface 230. The rotation of the fastener 216 also rotates the fastener's clamping portion 240 (the corner regions) from a first position or orientation within the mounting hole 234 (FIG. 8) to a second position or orientation overlaying or overlapping the mounting surface 230 (FIG. 5). The combined rotation and movement thus repositions the fastener's clamping portion 240 from an unclamped position within the mounting hole 234 to a clamped position abutting against the mounting surface 230. In the clamped position, the amplifier chassis 204 is thus mounted to the mounting surface 230 by a compressive clamping force applied to the mounting surface 230 generally between and by the interaction of the fastener 216 and the chassis 204.

In addition, the rotation of the fastener 216 may also forcibly insert the fastener's first portion 236 into the opening 252 of the amplifier chassis 204. Because the fastener's first portion 236 increases in size from its free end portion to its other end portion, the forcible insertion of the fastener's first portion 236 into the opening 252 of the amplifier chassis 204 may create a frictional or interference fit between the fastener 216 and the amplifier chassis 204. This frictional or interference fit between the fastener 216 and the amplifier chassis 204 may help provide a relatively good attachment or snug fit of the fastener 216 to the amplifier chassis 204.

FIGS. 11 through 13 illustrate another embodiment of an antenna assembly 300 embodying one or more aspects of the present disclosure. This embodiment is similar to the antenna assembly 100, in that the antenna assembly 300 includes a chassis or base 304, a printed circuit board 308, and electrical connectors 312, a claw fastener or mounting claw 316 (broadly, a fastener) and a guiding pin or bayonet 320. As before, the claw fastener 316 and pin 320 may be used for mounting the antenna assembly 300 to a vehicle body wall 330 (FIG. 11) (e.g., vehicle roof, hood, trunk lid, etc.) or other suitable mounting surface as disclosed herein.

But in this illustrative embodiment, the claw fastener or mounting claw 316 includes six legs or fingers 340 (not five legs or fingers 140 as did the claw fastener 116 in FIGS. 1 through 7). And, the claw fastener 316 includes a tool reception site in the form of a hexagonal head portion 348 (e.g., bolt head, etc.) that can be engaged with a wrench (as compared to the hexagonal openings 148 (FIG. 1) and 248 (FIG. 8)). The hexagonal head portion 348 may be attached to the claw fastener 316, or the hexagonal head portion 348 may be integrally formed with the claw fastener 316 as part of the claw fastener 316 itself. In either case, the installer may use a wrench for rotating the claw fastener 316. Alternative embodiments may include a fastener having a tool reception site with a different configuration compatible with a different tool, such as a slot compatible with a regular screw driver, an opening compatible with a Philips screwdriver, or a hexagonal opening compatible with an Allen wrench, etc. Moreover, additional embodiments may include more or less than six fingers 340, such as a fastener having a clamping portion defined by five fingers (e.g., FIGS. 1 through 7, etc.) or a fastener having a clamping portion without any fingers (e.g., FIGS. 8 through 10, etc.). Further embodiments may include fasteners with clamping portions in different configurations (e.g., different shapes, different sizes, etc.) than what is illustrated in the figures.

In addition, the mounting hole 334 is illustrated with a hexagonal shape in FIGS. 12 through 13, whereas FIG. 3 illustrated a pentagonal mounting hole 134. The hexagonal mounting hole 334 shown in FIGS. 12 and 13 may have a diameter of about 43.5 millimeters. Alternative embodiments may be used with mounting holes having different configurations, such as different shapes other than hexagonal, different sizes (e.g., diameter greater or less than 43.5 millimeters), etc. The particular configuration of mounting hole may depend, for example, on the particular features of the antenna assembly to be installed, such as the number and type of electrical connectors, number of legs or fingers of the claw fastener or mounting claw, etc.

Moreover, the antenna assembly 300 includes six FAKRA connectors 312 (not five connectors 112 as did the antenna assembly 100). Alternative embodiments of the antenna assembly 300, however, may include more or less than six connectors and/or different connectors besides FAKRA connectors, such as one or more ISO (International Standards Organization) standard electrical connector, etc. depending, for example, on the particular vehicle and/or application intended for the antenna assembly 300.

With continued reference to FIG. 11, the pin 320 is configured to be slidably received within first and second slots or grooves 324 of the claw fastener 316. The pin 320 is also configured to be engagingly received within openings of a portion or nub protruding (e.g., opening 128 in portion 132 in FIG. 1, etc.) generally outwardly from the chassis 304. By positioning the pin 320 within the slots 324 and openings, the claw fastener 316 may thus be retained and pre-mounted to the antenna assembly 300 before the antenna assembly 300 is positioned relative to or mounted to the vehicle body wall 330 (FIG. 11). Accordingly, the antenna assembly 300 (with the claw fastener 316 pre-mounted and retained thereto by the pin 320) may be positioned as a single unit from the external side of the vehicle along the vehicle body wall 330 such that the claw fastener 316 and FAKRA connectors 312 extend through the mounting hole 334. At which point, an installer inside the vehicle may access the claw fastener 316 and FAKRA connectors 312.

The claw fastener 316 includes a central hub or portion 336. The hub 336 has a generally rounded or ogival shaped upper portion. The hub 336 is tapered such that it increases in size (e.g., increases in diameter and circumference, etc.) from its free end portion (the top end portion shown in FIG. 11) to its other end portion (the lower end portion shown in FIG. 11). The hub 336 may be generally hollow and be configured for engagingly receiving a protruding portion of the chassis 304.

As shown by FIGS. 12 and 13, the claw fastener 316 includes a clamping portion defined by six fingers or legs 340 that extend outwardly from the hub 336. The six fingers 340 may be dimensionally sized such that the fingers 340 may be inserted freely through the mounting hole 334 with the end portions of the fingers 340 generally aligned with the corners of the hexagonal mounting hole 334. But upon rotation of the claw fastener 316, the fingers 340 may be rotated from a first position or orientation relative to mounting hole 334 (FIG. 12) to a second position or orientation in which the end portions of the fingers 340 overlap or overlay the vehicle body wall 330 (FIG. 13). In various embodiments, the mounting hole 334 and/or fingers 340 may be relatively sized dimensionally such that the fingers 340 overlap/overlay the vehicle body wall 330 and extend outwardly beyond the mounting hole 334 by a distance within a range of about 2 millimeters to about 3 millimeters (e.g., 2 millimeters, 2.5 millimeters, 3 millimeters, etc.). Alternative embodiments may be configured such that the fingers of the claw fastener extend or overlap the vehicle body wall by a distance greater than 3 millimeters or less than 2 millimeters.

In various embodiments, the claw fastener's fingers 340 may be configured with (e.g., provided with, integrally formed with, or have attached thereto claws or claw portions 144, etc.) so as to scratch the vehicle body wall 330 when the claw fastener 316 is rotated (e.g., clockwise rotation in FIGS. 3 through 5, etc.). The scratches may help provide good electrical grounding contact between the claw fastener 316 and the vehicle body wall 330. Alternative embodiments may include fasteners without any clawing portions, fasteners have more or less than one claw portion per finger, and/or fasteners with other means for scratching the vehicle body wall.

In some embodiments, the claw fastener 316 essentially operates as a spring element and is configured so as to not experience plastic deformation during use. By way of example only, the claw fastener 316 may be made of metal or other suitable material that will not be permanently deformed due to the stress imparted thereon from the installation process. Exemplary materials out of which the claw fastener or mounting claw 316 may be made include stainless steel, DC04 steel, austenitic stainless steel 1.4301, C60 steel, etc. The claw fastener or mounting claw 116 may be made out of a material(s) having a thickness falling within a range from about 0.6 millimeter to about 1 millimeter, e.g., 0.6 millimeter thickness, 0.7 millimeter thickness, 0.8 millimeter thickness, 0.9 millimeter thickness, 1 millimeter thickness, etc. Alternative embodiments may include the use of other materials having other dimensions for the claw fastener or mounting claw 316. The particular materials and dimensions disclosed in this paragraph and elsewhere herein are provided for purposes of illustration only and should not be considered limiting.

Also shown in FIG. 11 are clips, tabs, or pre-catch mechanisms 368 and positioning blocks 372 on the chassis 304. In use, the positioning blocks 372 help with the positioning and alignment of the antenna assembly 300 relative to the mounting hole 334. The clips 368 help temporarily retain and hold the antenna assembly 300 in place relative to the vehicle body wall 330 by virtue of the clips 368 being snapped under or positioned on the interior compartment side of the vehicle body wall 330 while the antenna chassis 304 is on the exterior side of the vehicle body wall 330.

An exemplary installation process will now be described for the antenna assembly 300. The printed circuit board 308 may be positioned relative to the chassis 304 such that the FAKRA connectors 312 extend through the openings 322 of the chassis 304. The claw fastener 316 may be positioned relative to the chassis 304, such that a nub/protruding portion of the chassis 304 is received within the opening of the claw fastener's hub 336 and such that openings of the chassis' nub are aligned with the bayonet locking slots 324 of the claw fastener 316. The pin 320 may then be positioned within the slots 324 and openings, to thereby retain and pre-mount the claw fastener 316 to the chassis 304. The antenna assembly 300 (with the claw fastener 316 pre-mounted or retained thereto by the engagement of the pin 320 within the slots 324 and openings) may then be positioned (from outside the vehicle) as a single unit relative to the mounting hole or cutout portion 334 of the vehicle body wall 330, such that the antenna assembly 300 is along the vehicle body wall 330 and the claw fastener 316 and FAKRA connectors 312 extend through the mounting hole 334 and are accessible from inside the vehicle. During this positioning step, the clips 368 may be positioned or snapped under the interior compartment side of the vehicle body wall 330 while the antenna chassis 304 is on the exterior side of the vehicle body wall 330, thus helping temporarily retain and hold the antenna assembly 300 in place relative to the vehicle body wall 330. From inside the vehicle, the installer may then use a tool (e.g., wrench, etc.) to rotate the claw fastener 316. With the rotation of the claw fastener 316, the pin 320 travels or slides within the bayonet locking slots 324. This, in turn, causes the claw fastener 316 to move in a direction generally vertical or perpendicular to the rotation, such that the claw fastener's fingers 340 moves generally towards the vehicle body wall 330. The rotation of the claw fastener 316 also rotates the claw fastener's fingers 340 from a first position within the mounting hole 334 (FIG. 12) to a second position overlapping or overlaying the vehicle body wall 330 (FIG. 13). The combined rotation and movement of the claw fastener 316 repositions the claw fastener's legs 340 from an unclamped position within the mounting hole 334 to a clamped position abutting against the vehicle body wall 330. In the clamped position, the antenna assembly 300 is thus mounted to the vehicle body wall 330 by a compressive clamping force applied to the vehicle body wall 330 generally between and by the interaction of the claw fastener 316 and the chassis 304.

Also from inside the vehicle, the installer may plug electrical connectors at the ends of communication links (e.g., coaxial cables, etc.) into the antenna assembly's electrical connectors 312. The other ends of the communication links may be electrically connected to other devices, such as a radio receiver, display screen, other suitable devices, etc. Accordingly, the communication links may be used for communicating signals from the antenna assembly 300 to the other devices.

FIG. 14 illustrates an exemplary frame 472 for mounting the FAKRA connectors 412 that may be used with embodiments disclosed herein, such as embodiments including a claw fastener or mounting claw 416, which may be identical to or substantially similar to the claw fastener 116 or 316 described above. In use, the frame 472 may be placed directly on a printed circuit board 408 such that the printed circuit board 408, frame 472, and antenna base or chassis 404 may be mechanically fastened (e.g., screwed, bolted, etc.) together as indicated by the designated portion 476. Consequently, this allows for elimination or at least a reduction of the direct force that would otherwise be directed or guided to the printed circuit board 408 during the fastening or mounting of the frame 472, printed circuit board 408, and chassis 404 from the FAKRA coupler at the harness on to the printed circuit board 408.

FIG. 15 is a side perspective of the frame 472 and FAKRA connectors 412. As shown, the frame 472 includes mounting latches, flanges, or protruding portions 480 that include fastener holes 484. Accordingly, mechanical fasteners may be inserted through the fastener holes 484 for mechanically fastening the printed circuit board 408, frame 472, and antenna base or chassis 404 together as indicated by designated portion 476 in FIG. 14. The mounting latches 480 may be configured to transmit, guide, or direct the force applied via the mechanical fasteners on or to the chassis 404, to thereby help avoid the transfer direct force on or to the printed circuit board 408 while mounting the FAKRA coupler. Thus, the mounting latches 480 transmit the force created by the mechanical fastening of the printed circuit board 408, frame 472, and antenna chassis 404 to the chassis 404 such that the force is not transmitted to the printed circuit board 408.

One or more of the embodiments disclosed herein may include a frame 472 substantially similar to an embodiment of a frame, connector device, or mounting means disclosed in U.S. patent application Ser. No. 12/161,184 filed Jul. 17, 2008, which is a national phase of PCT International Application No. PCT/EP2007/000376 filed Jan. 17, 2007, published as WO2007/082727 on Jul. 26, 2007, which claims priority to German Patent Application No. and Publication No. DE202006000720.2 filed Jan. 17, 2006, issued Apr. 20, 2006. The entire disclosures of the above applications are incorporated herein by reference in their entirety.

FIGS. 1-5 and 11-13 respectively illustrate embodiments in which claw fasteners or mounting claws 116, 316 are used to mount antenna modules or assemblies to vehicle body wall 130, 330. FIGS. 8-10 illustrate an embodiment in which the fastener 216 (having a generally rectangular clamping portion) is used to mount an amplifier chassis. Aspects of the present disclosure, however, may be used with other antenna modules, assemblies, and/or components. For example, other embodiments may include mounting apparatus or methods as disclosed herein for mounting an assembly to a mounting surface, where the assembly includes at least a portion of a receiver or transceiver.

Embodiments and aspects of the present disclosure may be used in a wide range of applications, such as patch antennas, telematics antennas, antennas configured for receiving satellite signals (e.g., Satellite Digital Audio Radio Services (SDARS), Global Positioning System (GPS), cellular signals, etc.), antennas configured for receiving RF energy or radio transmissions (e.g., AM/FM radio signals, etc.), antennas or receivers/transceiver configured for use with signals associated with one or more of WiFi, WiMax, DSRC (Dedicated Short Range Communications), etc., combinations thereof, among other signals communicated between antennas, receivers/transceivers, etc.

Embodiments and aspects of the present disclosure may be used for mounting various antenna assemblies, modules, and components to a wide range of mounting surfaces, including stationary platforms and mobile platforms. For example, an antenna assembly disclosed herein could be mounted to a surface of a bus, train, aircraft, among other mobile platforms, as well as to stationary platforms. Accordingly, the specific references to vehicle herein should not be construed as limiting the scope of the present disclosure to any specific type of supporting structure or environment.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The description of the disclosure is merely exemplary in nature and, thus, variations that do not depart from the gist of the disclosure are intended to be within the scope of the disclosure. Such variations are not to be regarded as a departure from the spirit and scope of the disclosure.

What is claimed is:

1. An apparatus for mounting at least one antenna component to a mounting surface, the apparatus comprising:

a fastener having a clamping portion; and an actuator including one or more slots and a pin slidably received within the one or more slots, whereby the actuator is configured to convert a rotational force applied for rotating the fastener relative to the at least one antenna component into a clamping force applied to the mounting surface generally between the at least one antenna component and the clamping portion of the fastener, to thereby mount the at least one antenna component to the mounting surface.

2. The apparatus of claim 1, wherein the actuator comprises a bayonet locking structure configured such that sliding movement of the pin within the one or more slots during rotation of the fastener causes movement of the fastener in a direction generally perpendicular to the rotation.

3. The apparatus of claim 1, wherein the fastener is configured to be inserted through a mounting hole in the mounting surface in a first orientation and be rotated to a second orientation in which at least a portion of the clamping portion overlays and abuts a portion of the mounting surface.

4. The apparatus of claim 1, wherein:

the fastener includes the one or more slots;

the at least one antenna component includes one or more openings alignable with the one or more slots and configured for receiving the pin therein, whereby prior to mounting of the at least one antenna component to the mounting surface, the fastener may be retained to the at least one antenna component by engagement of the pin with the one or more slots and the one or more openings.

5. The apparatus of claim 1, wherein:

the at least one antenna component includes the one or more slots;

the fastener includes one or more openings alignable with the one or more slots and configured for receiving the pin therein, whereby prior to mounting of the at least one antenna component to the mounting surface, the fastener may be retained to the at least one antenna component by engagement of the pin with the one or more slots and the one or more openings.

6. The apparatus of claim 1, wherein the fastener includes a hub with one or more spaced-apart fingers extending outwardly therefrom to thereby define the clamping portion.

7. The apparatus of claim 1, wherein the fastener includes at least one claw portion configured to scratch the mounting surface when the fastener is rotated relative to the mounting surface, to help provide electrical grounding contact between the fastener and the mounting surface.

8. The apparatus of claim 1, wherein the fastener is configured to operable as a spring element without undergoing plastic deformation, for mounting of the at least one antenna component to the mounting surface.

9. The apparatus of claim 1, wherein the fastener includes a tool reception site configured to allow an installer to rotate the fastener by using a corresponding tool.

10. An assembly comprising the apparatus of claim 1 and at least one antenna component including one or more:

an amplifier chassis;

an antenna chassis;

at least one component of an antenna module;

at least one component of an RF amplifier module;

at least a portion of a receiver or transceiver; or at least a portion of a receiver or transceiver configured for use with signals associated with one or more of WiFi, WiMax, and/or DSRC (Dedicated Short Range Communications).

11. An antenna module comprising the apparatus of claim 1 and a chassis including one or more openings alignable with the one or more slots and configured for receiving the pin therein, wherein the fastener includes the one or more slots and is retained to the chassis by the engagement of the pin with the one or more slots and the one or more openings.

12. The antenna module of claim 11, wherein:

the chassis is configured to be disposed along an external side of a vehicle body wall; and the fastener is configured to be inserted through a mounting hole in the vehicle body wall in a first orientation from outside the vehicle, and be rotated from inside the vehicle to a second orientation in which at least a portion of the clamping portion overlays a portion of the vehicle body wall;

whereby during rotation of the fastener from the first orientation to the second orientation, the pin slides within the one or more slots and causes movement of the fastener in a direction generally towards the vehicle body wall such that a clamping force is applied to the vehicle body wall generally between the chassis and the clamping portion of the fastener in the second orientation, to thereby mount the antenna module to the vehicle body wall.

13. The antenna module of claim 11, further comprising one or more electrical connectors accessible from inside the vehicle, when the chassis is disposed along the external side of the vehicle body wall, for a pluggable electrical connection to at least one communication link for communicating signals received by the antenna module to at least one other device.

14. An RF amplifier module comprising the apparatus of claim 1 and a chassis including the one or more slots, wherein the fasteners includes one or more openings alignable with the one or more slots and configured for receiving the pin therein, such that the fastener may be retained to the chassis by the engagement of the pin with the one or more slots and the one or more openings.

15. The RF amplifier module of claim 14, wherein:

the chassis is configured to be disposed along a first side of the mounting surface; and the fastener is configured to be inserted through a mounting hole in the mounting surface in a first orientation and be rotated to a second orientation in which at least a portion of the clamping portion overlays a portion of the mounting surface;

whereby during rotation of the fastener from the first orientation to the second orientation, the pin slides within the one or more slots and causes movement of the fastener in a direction generally towards the mounting surface such that a clamping force is applied to the mounting surface generally between the chassis and the clamping portion of the fastener in the second orientation, to thereby mount the RF amplifier module to the mounting surface.

16. The apparatus of claim 1, wherein the clamping portion is configured with a perimeter or footprint having a shape corresponding to the shape of the mounting hole in the mounting surface.

17. An antenna module comprising the apparatus of claim 1 and a chassis including one or more openings alignable with the one or more slots and configured for receiving the pin therein, wherein the fastener includes the one or more slots and is retained to the chassis by the engagement of the pin with the one or more slots and the one or more openings.

18. The antenna module of claim 17, wherein:

the chassis is configured to be disposed along an external side of a vehicle body wall; and the fastener is configured to be inserted through a mounting hole in the vehicle body wall in a first orientation from outside the vehicle, and be rotated from inside the vehicle to a second orientation in which at least a portion of the clamping portion overlays a portion of the vehicle body wall.

19. An apparatus for mounting an antenna module having a chassis to a mounting surface having a mounting hole, the apparatus comprising:

a fastener includes a hub and a plurality of fingers extending outwardly from the hub to define a clamping portion, the fastener configured to be inserted through a mounting hole in the mounting surface in a first orientation and be rotated to a second orientation in which at least a portion of the fingers overlay a portion of the mounting surface; and an actuator configured to convert a rotational force applied for rotating the fastener into a clamping force applied to the mounting surface generally between the chassis and the clamping portion of the fastener, to thereby mount the chassis to the mounting surface.

20. The apparatus of claim 19, wherein the fastener includes at least one claw portion configured to scratch the mounting surface when the fastener is rotated relative to the mounting surface, to help provide electrical grounding contact between the fastener and the mounting surface.

21. The apparatus of claim 19, wherein the fastener includes at least five spaced-apart fingers that define the clamping portion.

22. The apparatus of claim 19, wherein the actuator comprises a bayonet locking structure.

23. The apparatus of claim 22, wherein the bayonet locking structure comprises:

one or more slots; and a pin slidably received within the one or more slots such that sliding movement of the pin within the one or more slots during rotation of the fastener causes movement of the fastener in a direction generally perpendicular to the rotation.

24. The apparatus of claim 23, wherein:

the fastener includes the one or more slots;

the chassis includes one or more openings alignable with the one or more slots and configured for receiving the pin therein, whereby prior to mounting of the antenna module to the mounting surface, the fastener may be retained to the chassis by engagement of the pin with the one or more slots and the one or more openings.

25. The apparatus of claim 19, wherein the fastener is configured to operate as a spring element without undergoing plastic deformation, for mounting of the antenna module to the mounting surface.

26. The apparatus of claim 19, wherein the fastener includes a tool reception site configured to allow an installer to rotate the fastener by using a corresponding tool.

27. A method relating to mounting at least one antenna component to a mounting surface, the method comprising attaching a fastener to the at least one antenna component prior to mounting the at least one component to the mounting surface, wherein the fastener is attached to the at least one antenna component by engaging a pin within one or more slots defined by one of the fastener or the at least one antenna component and within one or more openings defined by the other one of the fastener and the at least one antenna component, whereby the one or more slots are defined such that the pin is slidable within the slots for converting a rotational force applied for rotating the fastener into a clamping force applied to the mounting surface generally between the at least one antenna component and a clamping portion of the fastener.

28. The method of claim 27, wherein the at least one antenna component is a chassis, and wherein the method further comprises:

positioning the chassis and fastener attached thereto relative to the mounting surface such that a clamping portion of the fastener is inserted through a mounting hole in the mounting surface; and rotating the fastener relative to the chassis, mounting surface, and the pin such that the pin slides within the one or more slots during rotation and causes movement of the fastener in a direction generally perpendicular to the rotation and towards the mounting surface and such that the fastener is rotated from a first orientation to a second orientation in which at least a portion of the clamping portion overlays and abuts a portion of the mounting surface.

* * * * *